US008793815B1

(12) United States Patent
Kelley-Mozsy

(10) Patent No.: US 8,793,815 B1
(45) Date of Patent: Aug. 5, 2014

(54) DETACHABLE RECONFIGURABLE MODULAR POCKET ASSEMBLAGE

(71) Applicant: Lillie P. Kelley-Mozsy, St. Louis, MO (US)

(72) Inventor: Lillie P. Kelley-Mozsy, St. Louis, MO (US)

( * ) Notice: Subject to any disclaimer, the term of this patent is extended or adjusted under 35 U.S.C. 154(b) by 0 days.

(21) Appl. No.: 14/016,103

(22) Filed: Sep. 1, 2013

(51) Int. Cl.
*A41D 27/20* (2006.01)

(52) U.S. Cl.
CPC ..... *A41D 27/20* (2013.01)
USPC ..... 2/247

(58) Field of Classification Search
USPC ..... 2/247, 248, 249, 250, 251, 252, 253, 2/86, 89, 92, 94, 95, 101, 102, 338; 224/606, 605, 607, 609, 652, 223
See application file for complete search history.

(56) References Cited

U.S. PATENT DOCUMENTS

| | | | | | |
|---|---|---|---|---|---|
| 860,395 | A | * | 7/1907 | Lindsey | 224/649 |
| 1,198,202 | A | * | 9/1916 | Drinkard | 224/200 |
| 1,290,827 | A | * | 1/1919 | Yergason | 224/623 |
| 1,797,359 | A | * | 3/1931 | Meyers | 224/587 |
| 1,970,081 | A | | 8/1934 | Eisendrath | |
| 2,515,298 | A | | 7/1950 | Feldman | |
| 2,538,677 | A | * | 1/1951 | Ferrand | 2/48 |
| 2,620,479 | A | * | 12/1952 | Buck | 2/94 |
| 2,648,325 | A | | 8/1953 | Siple | |
| 2,672,263 | A | * | 3/1954 | Alber | 224/602 |
| 2,717,391 | A | * | 9/1955 | Bracken | 2/94 |
| 3,476,102 | A | | 11/1969 | Sarnoff | |
| 3,621,191 | A | | 11/1971 | Cornwell | |
| 3,624,686 | A | * | 11/1971 | Beals | 434/98 |
| 3,678,936 | A | | 7/1972 | McCormick | |
| 3,874,000 | A | | 4/1975 | Altman | |
| 3,889,684 | A | | 6/1975 | Lebold | |
| 4,106,121 | A | * | 8/1978 | Belson | 2/102 |
| 4,381,025 | A | | 4/1983 | Schooley | |
| 4,556,055 | A | | 12/1985 | Bonner | |
| 4,585,003 | A | | 4/1986 | Meistrell | |
| 4,592,358 | A | | 6/1986 | Westplate | |
| 4,656,673 | A | | 4/1987 | Easton | |
| 4,805,241 | A | * | 2/1989 | Faccini | 2/102 |
| 4,819,846 | A | * | 4/1989 | Hannemann | 224/240 |
| 4,854,432 | A | | 8/1989 | Carpenter | |
| 4,964,402 | A | | 10/1990 | Grim | |
| D316,472 | S | * | 4/1991 | Flanagan | D2/829 |
| 5,014,359 | A | * | 5/1991 | Hanson | 2/94 |
| 5,050,596 | A | | 9/1991 | Walasek | |
| 5,129,560 | A | * | 7/1992 | Herman | 224/579 |
| 5,187,814 | A | | 2/1993 | Gold | |
| 5,240,156 | A | * | 8/1993 | Sicotte et al. | 224/583 |
| 5,269,023 | A | | 12/1993 | Ross | |
| 5,336,255 | A | | 8/1994 | Kanare | |
| 5,361,412 | A | * | 11/1994 | Perry | 2/69 |

(Continued)

*Primary Examiner* — Alissa L Hoey

(57) ABSTRACT

A detachable reconfigurable modular pocket assemblage (10) specifically configured for the insertion of therapeutic packets, rehabilitative weights, and general-purpose items. The main components are a chamber (12), upper chamber attachments (112), and lower chamber attachments (212). The chamber (12) has a plurality of pockets (50), with releasable mating attachment (40) attached to the peripheries. When the peripheries are connected, a chamber (12) is formed. The upper chamber attachments (112) have a plurality of pockets (150), with releasable mating attachment (140) attached to the peripheries. The lower chamber attachments (212) have a plurality of pockets (250), with releasable mating attachment (240) attached to the peripheries. To assemble the chamber (12) and its attachments (112) and (212) into a detachable reconfigurable modular pocket assemblage (10) the mating attachments (140) and (240) are attached to the mating attachments (40) located on the chamber (12).

5 Claims, 24 Drawing Sheets

(56) References Cited

U.S. PATENT DOCUMENTS

| | | | | | |
|---|---|---|---|---|---|
| 5,432,322 | A | | 7/1995 | Ingram | |
| 5,465,425 | A | * | 11/1995 | Crispin | 2/102 |
| D364,956 | S | | 12/1995 | Dull | |
| 5,509,515 | A | | 4/1996 | Guo | |
| 5,592,691 | A | * | 1/1997 | Ronald | 2/69 |
| 5,617,582 | A | * | 4/1997 | Burwell | 2/102 |
| 5,630,536 | A | * | 5/1997 | Bugnaski | 224/600 |
| 5,639,005 | A | * | 6/1997 | Chouinard | 224/580 |
| D388,611 | S | | 1/1998 | Shaw | |
| 5,768,706 | A | * | 6/1998 | Griffith et al. | 2/102 |
| 5,775,558 | A | * | 7/1998 | Montalbano | 224/627 |
| 5,785,980 | A | | 7/1998 | Mathewson | |
| 5,794,264 | A | * | 8/1998 | Yuen | 2/93 |
| 5,800,490 | A | | 9/1998 | Patz | |
| 5,826,273 | A | | 10/1998 | Eckes | |
| 5,826,841 | A | | 10/1998 | Lavore | |
| 5,835,983 | A | | 11/1998 | McMahen | |
| 5,893,502 | A | * | 4/1999 | Redzisz | 224/577 |
| 5,894,600 | A | * | 4/1999 | Chenefront | 2/69 |
| 5,909,802 | A | * | 6/1999 | Puco et al. | 2/102 |
| 5,935,157 | A | | 8/1999 | Harmon | |
| 5,943,700 | A | * | 8/1999 | Hammer et al. | 2/102 |
| D417,282 | S | | 11/1999 | Allen | |
| 5,991,925 | A | * | 11/1999 | Wu | 2/102 |
| 6,016,944 | A | * | 1/2000 | Girbert | 224/646 |
| 6,065,154 | A | * | 5/2000 | Hulings et al. | 2/102 |
| 6,108,816 | A | * | 8/2000 | Bradley | 2/102 |
| 6,109,495 | A | | 8/2000 | Hernandez | |
| D433,758 | S | | 11/2000 | Allen | |
| 6,146,413 | A | | 11/2000 | Harman | |
| 6,165,208 | A | | 12/2000 | Reyes | |
| 6,213,365 | B1 | * | 4/2001 | Stocke et al. | 224/665 |
| 6,216,931 | B1 | * | 4/2001 | Trawinski | 224/583 |
| 6,260,202 | B1 | * | 7/2001 | Villalobos et al. | 2/102 |
| 6,311,336 | B1 | * | 11/2001 | Gootrad | 2/251 |
| 6,416,534 | B1 | | 7/2002 | Montagnino | |
| 6,516,981 | B2 | * | 2/2003 | Perez et al. | 224/148.6 |
| 6,568,575 | B1 | * | 5/2003 | Bartholomew | 224/583 |
| 6,644,527 | B1 | * | 11/2003 | Karenga | 224/602 |
| RE38,497 | E | * | 4/2004 | Falk et al. | 2/94 |
| 6,839,917 | B1 | | 1/2005 | Landwehr | |
| 6,923,357 | B2 | * | 8/2005 | Smith | 224/605 |
| D518,953 | S | | 4/2006 | Kenimer | |
| 7,025,709 | B2 | | 4/2006 | Riggall | |
| 7,043,768 | B2 | | 5/2006 | Gogarty | |
| 7,444,685 | B2 | | 11/2008 | Rose | |
| 7,451,496 | B2 | | 11/2008 | Carey | |
| 7,464,413 | B2 | | 12/2008 | Todd | |
| 7,637,218 | B1 | * | 12/2009 | Burton | 108/43 |
| 7,762,096 | B2 | | 7/2010 | Fuchs | |
| 7,817,002 | B2 | * | 10/2010 | Fullerton et al. | 335/306 |
| 7,841,997 | B1 | | 11/2010 | Heller | |
| 7,870,982 | B2 | | 1/2011 | Dong | |
| 7,909,214 | B2 | | 3/2011 | Gold | |
| 7,931,569 | B2 | | 4/2011 | Del Monte | |
| D638,625 | S | | 5/2011 | Goraieb | |
| 7,980,242 | B1 | | 7/2011 | Wilhelm | |
| 7,985,192 | B2 | | 7/2011 | Sheehan | |
| 8,001,803 | B2 | | 8/2011 | Kanagaki | |
| 8,002,157 | B2 | | 8/2011 | Willows | |
| 8,002,721 | B2 | | 8/2011 | Thermal | |
| 8,032,951 | B1 | | 10/2011 | Nestberg | |
| 8,066,164 | B2 | | 11/2011 | Gregory | |
| 8,209,772 | B2 | * | 7/2012 | Curry | 2/48 |
| 8,225,973 | B1 | * | 7/2012 | Bellinson | 224/602 |
| 8,245,322 | B1 | * | 8/2012 | Bouza | 2/102 |
| 8,418,901 | B2 | * | 4/2013 | Stimmell | 224/275 |
| 8,490,216 | B2 | * | 7/2013 | Haynes | 2/102 |
| 2002/0148872 | A1 | * | 10/2002 | DeVolentine et al. | 224/665 |
| 2004/0016785 | A1 | * | 1/2004 | Timmons | 224/609 |
| 2005/0188450 | A1 | * | 9/2005 | Clark | 2/247 |
| 2008/0201816 | A1 | * | 8/2008 | Elliot | 2/51 |
| 2009/0031467 | A1 | * | 2/2009 | Swindells et al. | 2/51 |
| 2009/0089913 | A1 | * | 4/2009 | Ehrlickman | 2/83 |
| 2009/0095785 | A1 | * | 4/2009 | Woolery | 224/665 |
| 2010/0235963 | A1 | * | 9/2010 | Haydon | 2/207 |
| 2012/0291179 | A1 | * | 11/2012 | Shea | 2/102 |
| 2013/0167286 | A1 | * | 7/2013 | Hudson | 2/102 |
| 2013/0305429 | A1 | * | 11/2013 | Haynes | 2/102 |

* cited by examiner

DETACHABLE RECONFIGURABLE MODULAR POCKET ASSEMBLAGE

BACKGROUND

1. Field of the Present Disclosure

Embodiments of the present disclosure relate to a detachable reconfigurable modular pocket assemblage, for the insertion of therapeutic packs, exercise weights, and a variety of other items.

2. Description of Prior Art

The use of pockets is known in the prior art. More specifically, pockets on: Belts U.S. Pat. No. D518, 953; pouches U.S. Pat. No. D388, 611; backpacks U.S. Pat. Nos. 6,109,495; 7,959,048; 8,066,164; body packs U.S. Pat. Nos. 5,016,629; 5,336,255; diaper bag U.S. Pat. No. 8,001,803; sports bag U.S. Pat. No. D638,625; tool bags U.S. Pat. No. 6,889,834; handbags U.S. Pat. No. 5,509,515; shoulder strap and waist belt bag U.S. Pat. No. 7,909,214; mittens and gloves U.S. Pat. Nos. 1,970,081; 5,050,596; 5,187,814; 7,451,496; wearing apparel U.S. Pat. Nos. 2,648,325; 3,476,102; 5,826,273; 6,178,559; 7,464,413; 6,839,917; 8,032,951; D417,282; bandage U.S. Pat. Nos. 4,556,055; 4,846,176; and, slings U.S. Pat. No. 7,841,997.

The aforementioned prior art is known to consist of familiar, expected and obvious structural configurations, for the fulfillment of countless objectives and requirements, but they have the shortcomings of not being a multifunctional assemblage, that can be detached and reconfigured for other uses.

Outdoor activities, particularly those participated in during the hotter times of the year, may lead to overheating, fatigue, excessive perspiring, and other related discomforts. It is a known fact that cool compresses or other such cooling devices can relieve many of the symptoms related to overheating and preventing consequences that are more serious. U.S. Pat. No. 7,762,096, to Fuchs, is a temperature control vest for use in providing cooling for workers subject to extreme temperature work environments.

The temperature control vest includes chest-covering pieces and a back-covering piece that are connected by adjustable straps that run over the shoulders of the user and lacing assemblies that pass around the sides of the user. The chest-covering pieces include detachable panels for holding separate replaceable ice sheets in separate compartments. The main objective of this prior art is to provide a temperature control vest with a simple design that allows for the insertion of ice sheets. The temperature control vest is not multifunctional or reconfigurable.

It has long been an accepted medical practice to apply cooling elements such as ice to ease body discomforts, because cold packs accelerates and enhances the healing process. In the case of injuries, the optimum time to begin cooling a traumatized area of the body is immediately after the incident occurs. Cold packs relieve muscular aches and pains caused by activities requiring extended use of the arms and legs, such activities include therapeutic massage, data entry, jogging and running.

The value of heat treatments for easing or preventing pain in muscle tissue is a well established practice. For example, muscles that tend to cramp, benefit from the application of heat before strenuous exercise to enrich the blood supply to the appropriate areas. Localized injury or pain, which may be caused by torn muscles and connective tissues, has been therapeutically treated using heat, because heat speeds and enhances the healing process.

There are various products on the market to apply heat treatments to the human body. Pockets, holders, pouches, hot water bottles, bags and the like, are used in combination with heat and serve as a barrier between the heat application and the user's skin. There have been many improvements in the application of heat treatments, U.S. Pat. No. 4,381,025 to Schooley shows a hot or cold pack, which wraps around a portion of the body by the use of hook and pile fasteners. U.S. Pat. No. 3,678,936 to McCormick, U.S. Pat. No. 3,889,684 to Lebold, and U.S. Pat. No. 4,592,358 to Westplate, describe therapeutic hot or cold packs having compartments that fastened to a body by the use of straps. However, the aforementioned prior art does not have the advantages of being a single assemblage that is, affordable, convenient, detachable, modular, reconfigurable, and multipurpose.

There are two main benefits to using weighted packs for fitness purposes. First, they offer a form of resistance training where the user's muscles are forced to work harder than usual in order to stimulate muscle growth. Secondly, weighted packs can aid in the development of muscle strength because the user is often able to perform repetitious, exercises while wearing the pack. The advantages of a weighted pack specifically designed for the general and aging population to use as a training tool which provides these two benefits simultaneously, would be significant. Muscle strength allows a person especially the aging population to keep and maintain a strong vibrant body and it plays a large role in the lives of those who desire independent living and mobility. U.S. Pat. No. 7,931,569 to Del Monte relates to belts in general and to weighted belts in particular. This is a single function weighted belt assemblage, worn on top of or integrated into the protective pants by hockey players.

There are many general use assemblages with pockets, some with waist belts, some with shoulder straps, some with a chamber, and there are many that have both waist belts and shoulder straps, with either removable or fixedly attached shoulder straps or waist belts, and many bags with loops and hooks, for attachment or securing purposes. U.S. Pat. No. 8,002,157 to Willows, is a waist pack that includes a sleeve for securely retaining a bottle or other containers while at the same time allowing for convenient removal and replacement. However, this prior art appears to be a single function assemblage.

Objectives and Advantages

One of the objectives of the applicant of the illustrated embodiments is to overcome the shortcomings of the prior art. Arrangements of other devices may appear at first to have similarities with the illustrated embodiments, but they differ in material respects. It is believed that none of the prior art devices achieves the convenience, versatility, and economy, provided by the illustrated embodiments. The unique placement of releasable mating attachments such as hooks and loops, provides features that the prior art does not provide in a single assemblage.

In some respects the detachable, reconfigurable, modular assemblage of pockets, according to the illustrated embodiments substantially departs from the conventional concepts and designs of the prior art. This assemblage of pockets provides an apparatus that has combined the features of the illustrated embodiments to provide one assemblage that is, a reconfigurable therapeutic assemblage, a reconfigurable weighted exercise pack assemblage, and a reconfigurable general use assemblage.

Accordingly, the main objective of the illustrated embodiments is to construct a multi functional pocket assemblage that has a modular design that is detachable and reconfigurable.

Several other objectives and advantages of the illustrated embodiments are:

(1) To provide an assemblage of pockets for the insertion of hot or cold packs for therapeutic use on the body.

(2) To provide an assemblage in which cooling packs can be inserted and used by people who spend time in the heat.

(3) To provide an assemblage for the insertion of heat packs for people who spend time in the cold.

(4) To provide an assemblage of pockets which can be used as a hot sweat wrap when heat packs are inserted into the pockets.

(5) To provide an assemblage of pockets for the insertion of weight packs and used for strengthening, and rehabilitating muscles of the body.

(6) To provide a pocket assemblage, for carrying items that need to remain cold or warm such as water, sports drinks, and certain medicines.

(7) To provide a multi use assemblage with pockets, for such items as a cell phone, keys, a wallet, glasses, and first aid items.

Other Advantages of the Illustrated Embodiments are:

(8) They are lightweight.

(9) They are comfortable.

(10) They are easy to clean.

(11) They are easy to store.

(12) They are reusable.

(13 They are not restrictive when used on the body

(14) They are affordable.

(15) Low shipping and handling cost.

(16) Hot/cold pack inserts are available in stores.

(17) A person can make the ice, heat and weight pack inserts.

(18) Each section of the assemblage can be used separately.

(19) They can be reconfigured and used as a: Arm sling, backpack, and chest pack, vest, foot chamber or wrap, arm wrap, leg wrap, hand chamber or wrap, finger chamber or wrap, neck wrap, head wrap, chin wrap, waist wrap, hand bag, shoulder bag, fanny pack carrier, heating pad, ice pad, therapeutic pillow and a therapeutic mat.

These and other objectives of the illustrated embodiments are accomplished by means of the present device, which comprises a chamber with pockets, shoulder straps with pockets, and waist straps with pockets.

A detachable reconfigurable modular pocket assemblage is configured when connecting the shoulder straps and the waist straps to the chamber panels. The parts are reconfigurable in that they can be detached and used for other purposes.

Due to its design, and the strategic placement of mating attachments such as hooks and loops, the illustrated embodiments are able to provide more functions than most other devices that are available today.

These and other objects and many of the attendant advantages of the illustrated embodiments will be evident, by reference to the following detailed description when considered in connection with the accompanying drawings.

BRIEF DESCRIPTION OF THE DRAWING FIGURES

All the drawings provided in this application are example constructions and are not, meant to limit the scope of the invention. In the drawings, closely related figures have the same number but different alphabetic suffixes. A more complete understanding of various embodiments of the present disclosure may be obtained by reference to the detailed description when taken in conjunction with the accompanying drawings, wherein:

FIG. 1A gives an overall anterior elevated view of the detachable reconfigurable modular pocket assemblage.

FIG. 1B provides a spread of the individual parts of the detachable reconfigurable modular pocket assemblage chamber.

FIG. 1C provides a spread of the individual parts of the detachable reconfigurable modular pocket assemblage upper chamber attachment.

FIG. 1D provides a spread of the individual parts of the detachable reconfigurable modular pocket assemblage lower chamber attachment.

FIG. 1E provides an elevated anterior view of the individual chamber panel and a partial set of its components assembled together.

FIG. 1F provides an elevated anterior view of the upper chamber attachment and a partial set of its components assembled together.

FIG. 1G provides an elevated anterior view of the lower chamber attachment and a partial set of its components assembled together.

FIG. 2A gives a detailed anterior elevated view of the chamber panel and most of its components assembled.

FIG. 2B gives a detailed posterior elevated view of the chamber panel and most of its components assembled.

Figure 2A:
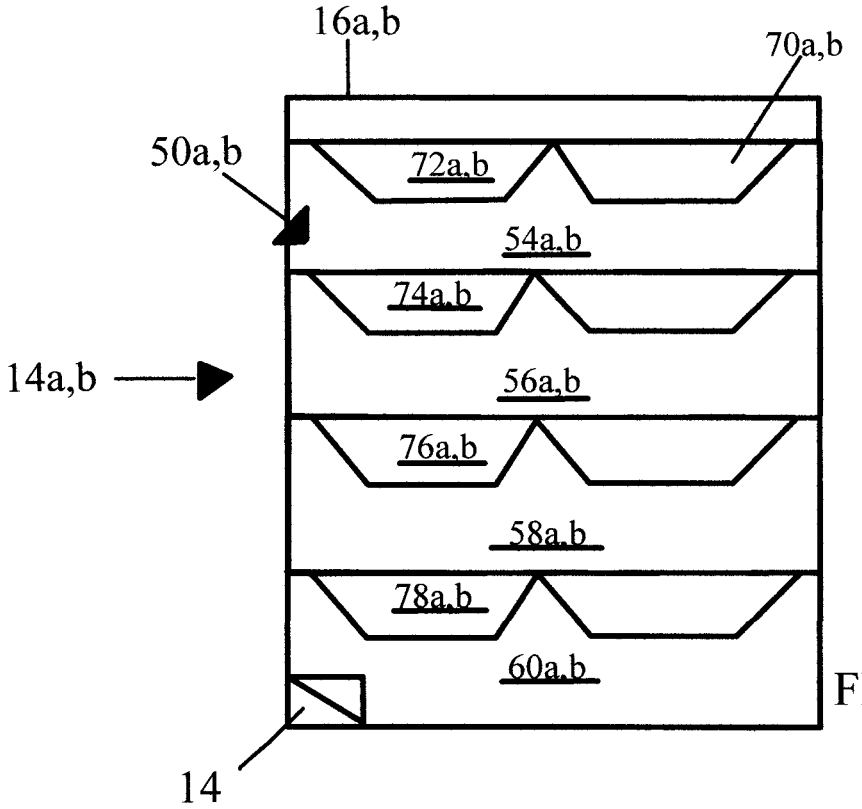
FIG. 2C illustrates an anterior elevated view of the placement of a plurality of loops and hooks that are attached to the pockets of the chamber panel assemblage.
FIG. 2D illustrates a posterior elevated view of the placement of a plurality of loops and hooks that are attached to the pockets of the chamber panel assemblage.
Figure 2B:
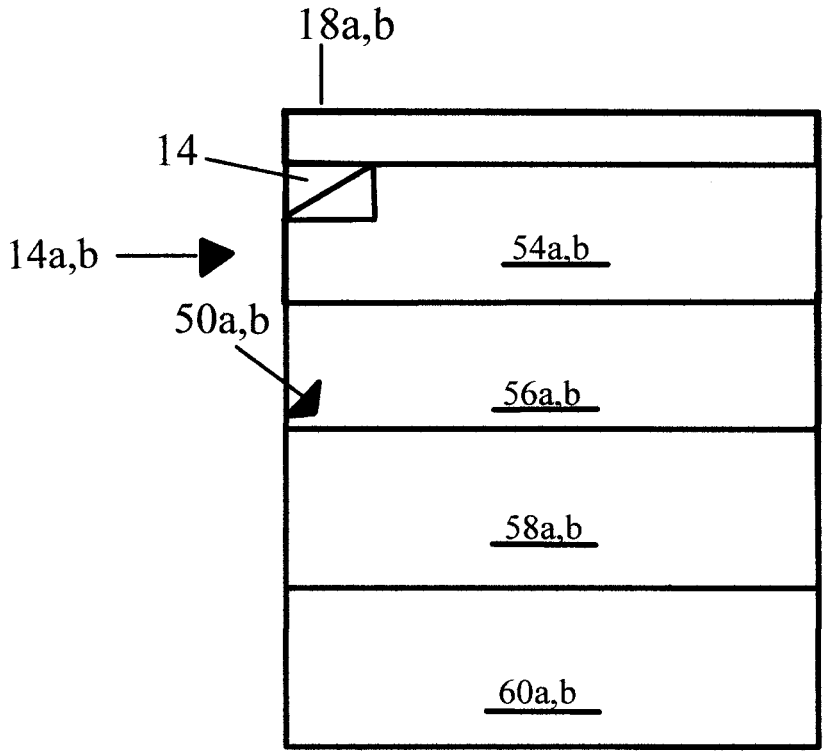
Figure 2C:
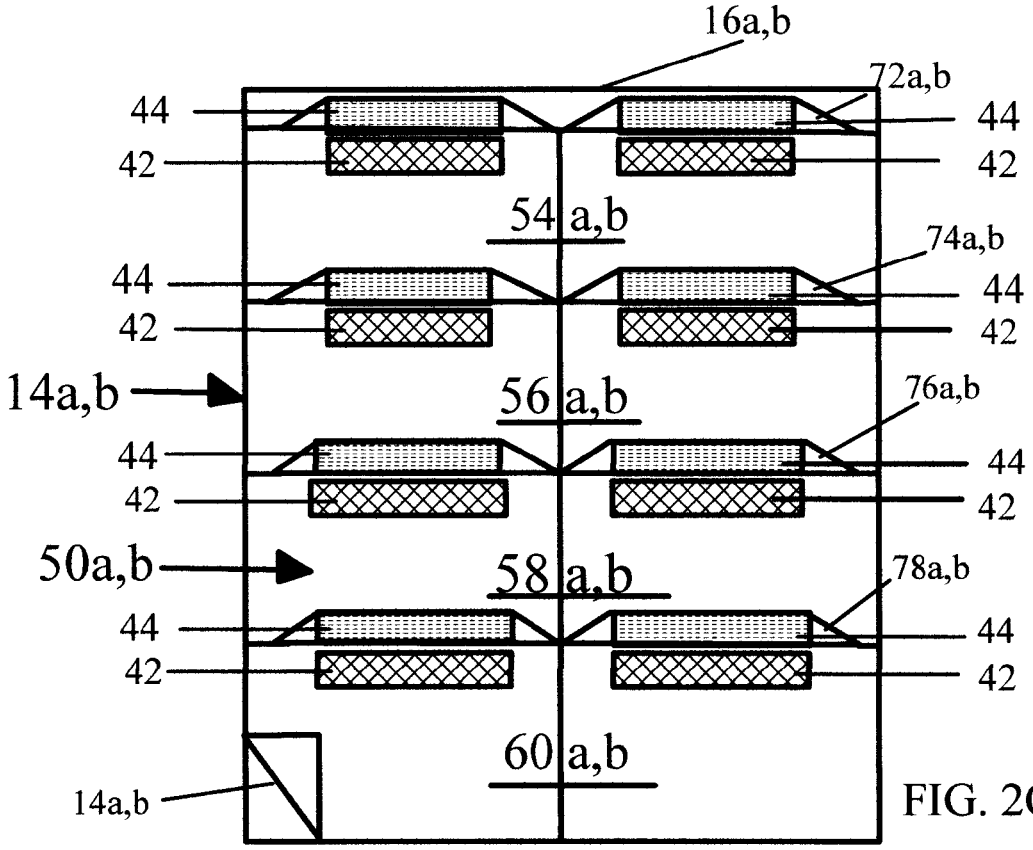
Figure 2D:
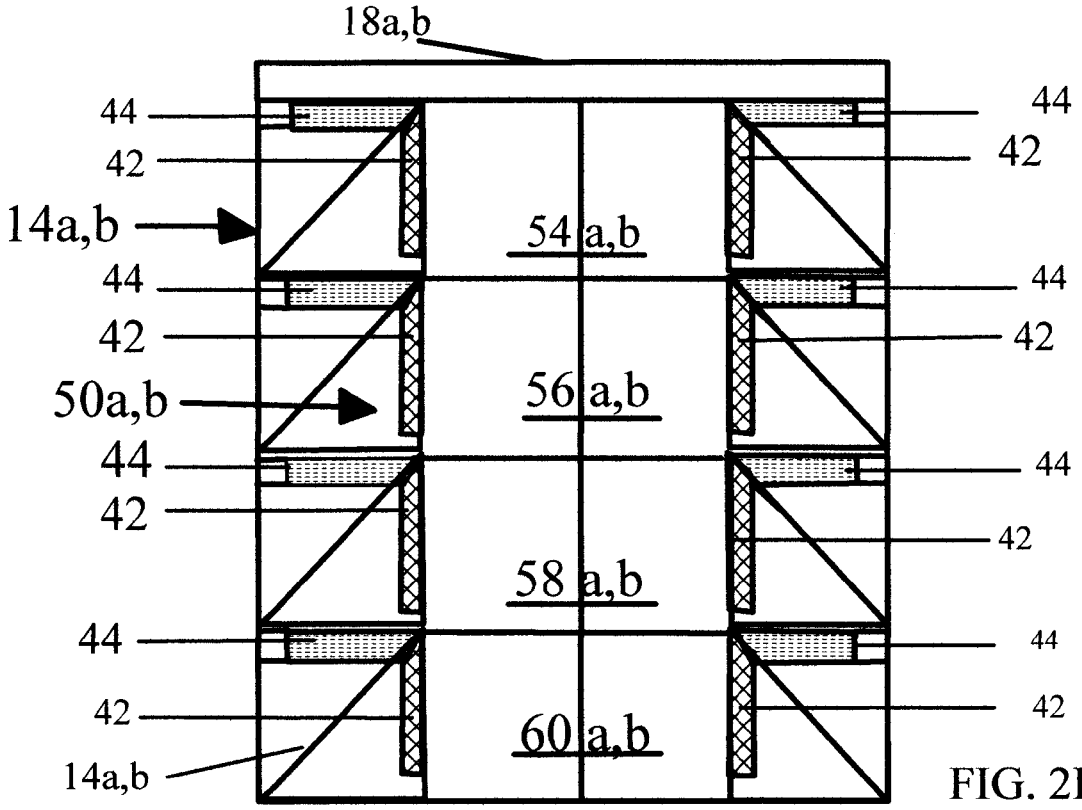
Figure 2E:
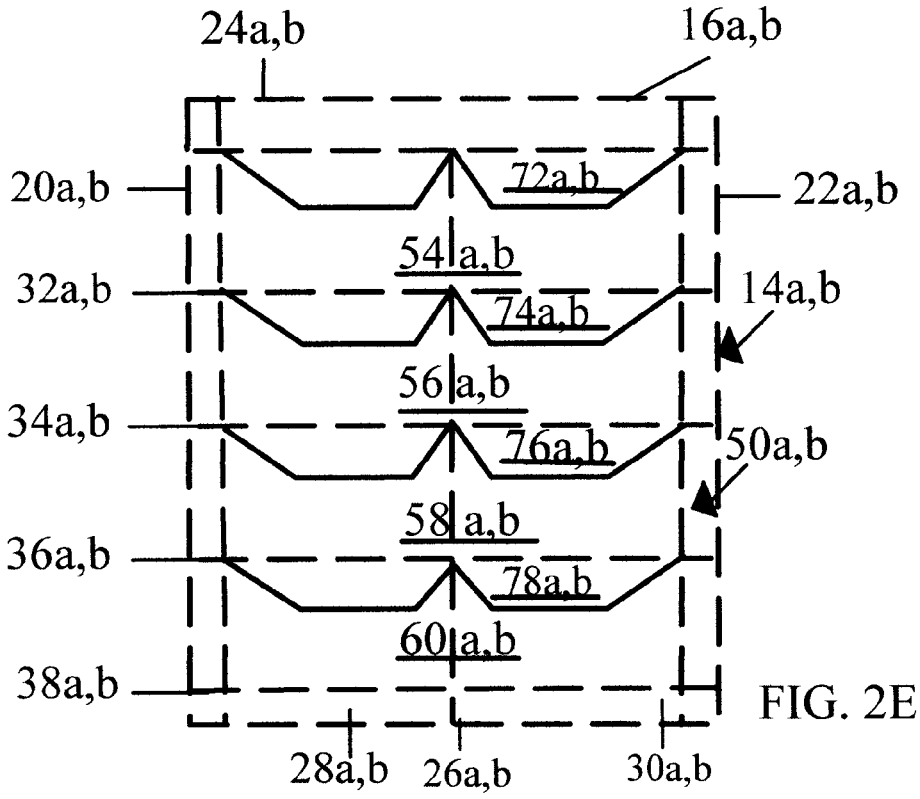

FIG. 2E gives a detailed anterior elevated view of the chamber panel with rows and columns and most of its components assembled and secured together.

Figure 2F:
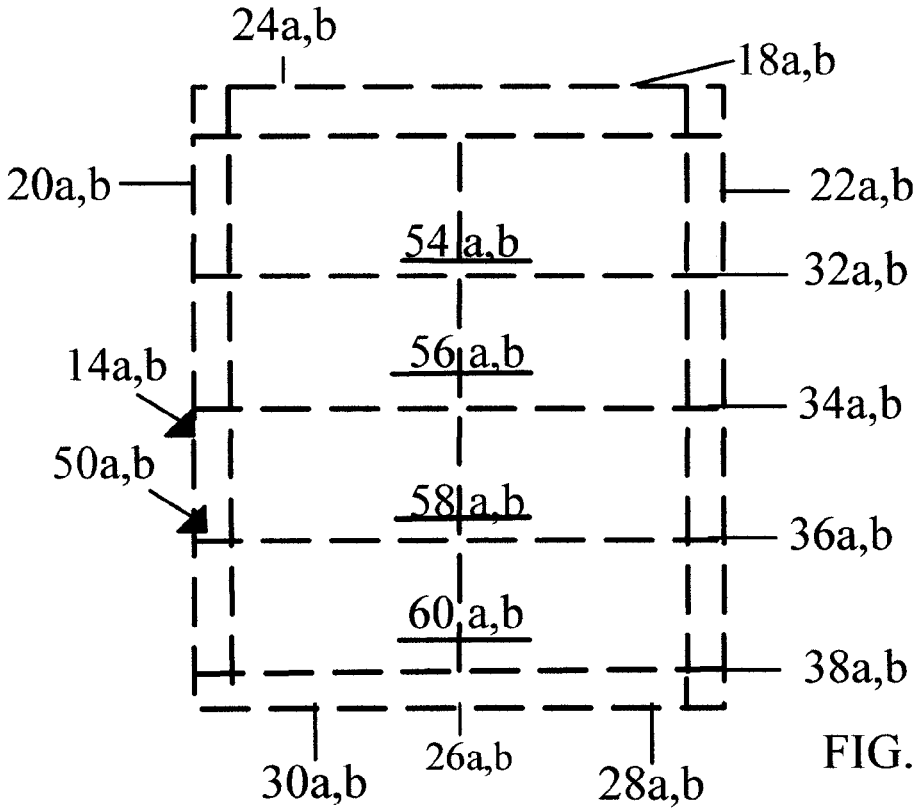

FIG. 2F gives a detailed posterior elevated view of the chamber panel with rows and columns and most of its components assembled and secured together.

Figure 2G:
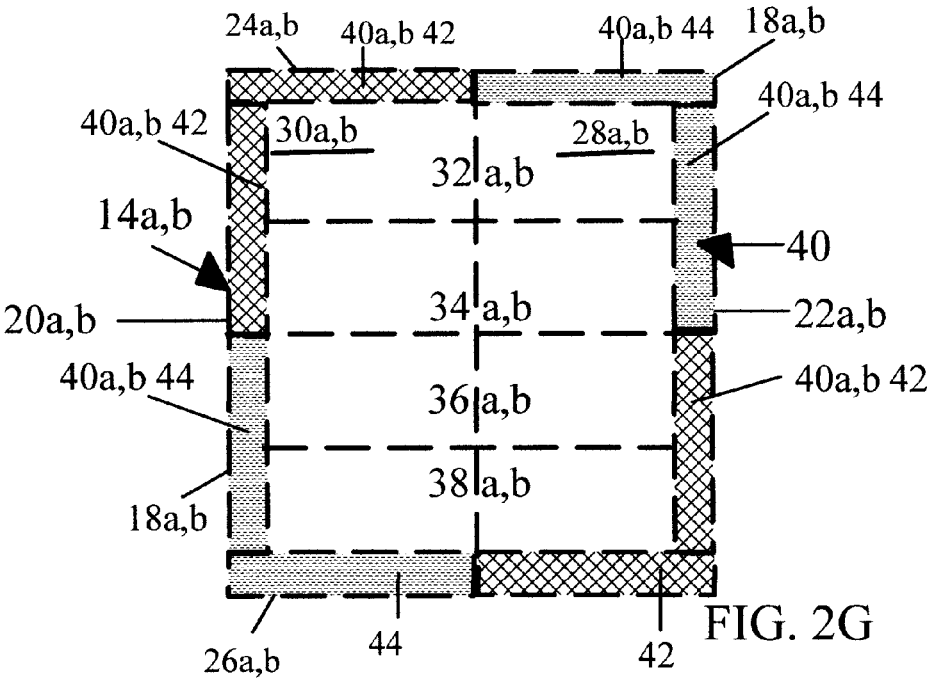

FIG. 2G illustrates a posterior elevated view of the placement of chamber mating attachments hooks and loops, attached to the chamber panel assemblage peripheries.

Figure 2H:
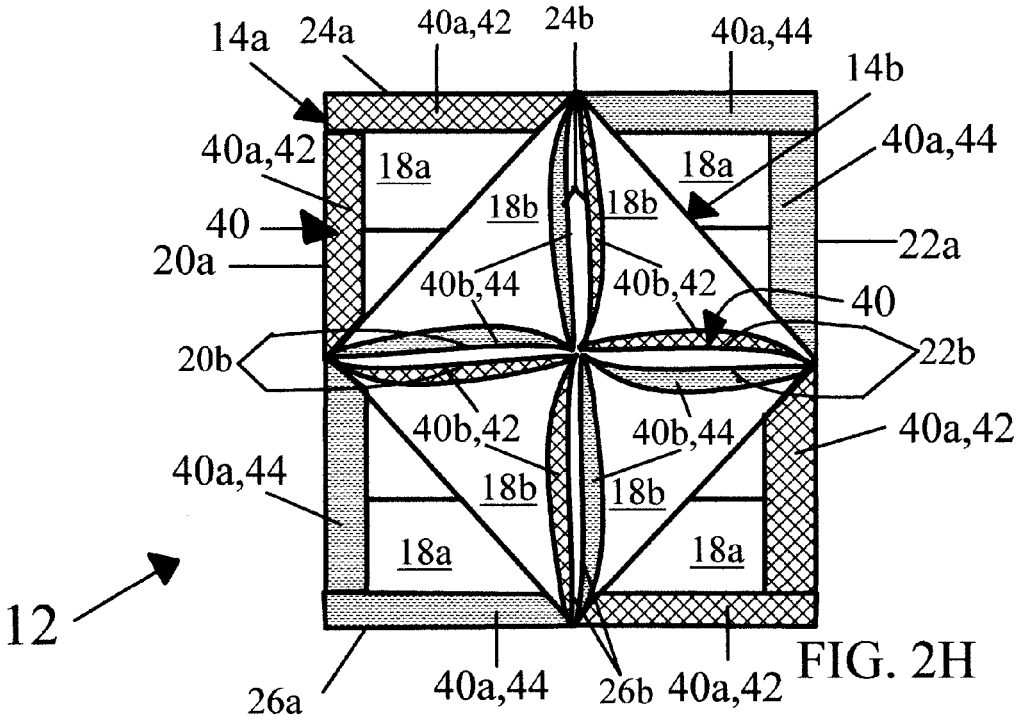

FIG. 2H illustrates an elevated view of the alignment of a plurality of loops and hooks attached to the chamber's peripheries.

Figure 3A:
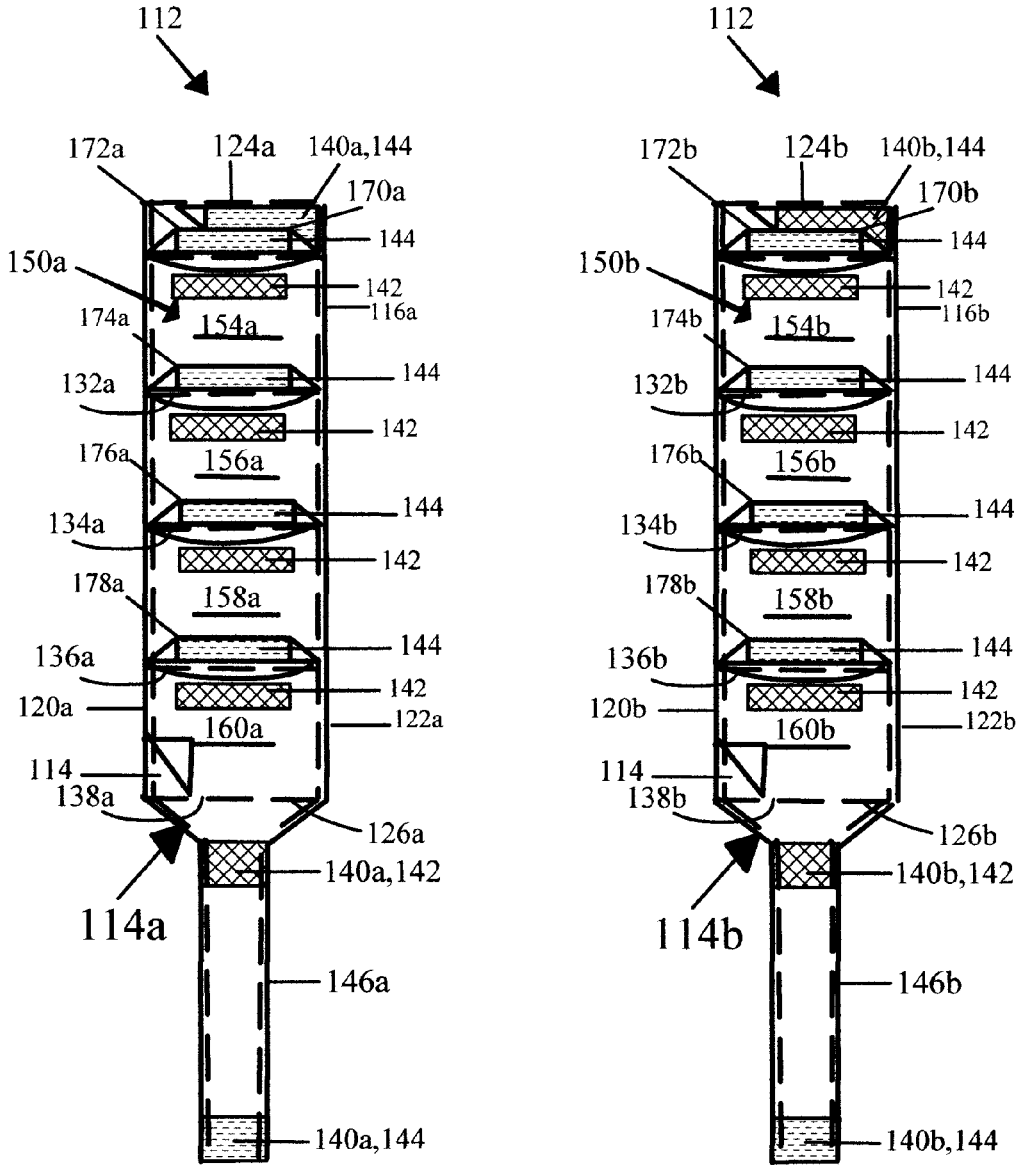

FIG. 3A gives a detailed anterior elevated view of the upper chamber attachments of the detachable reconfigurable modular pocket assemblage.

Figure 3B:
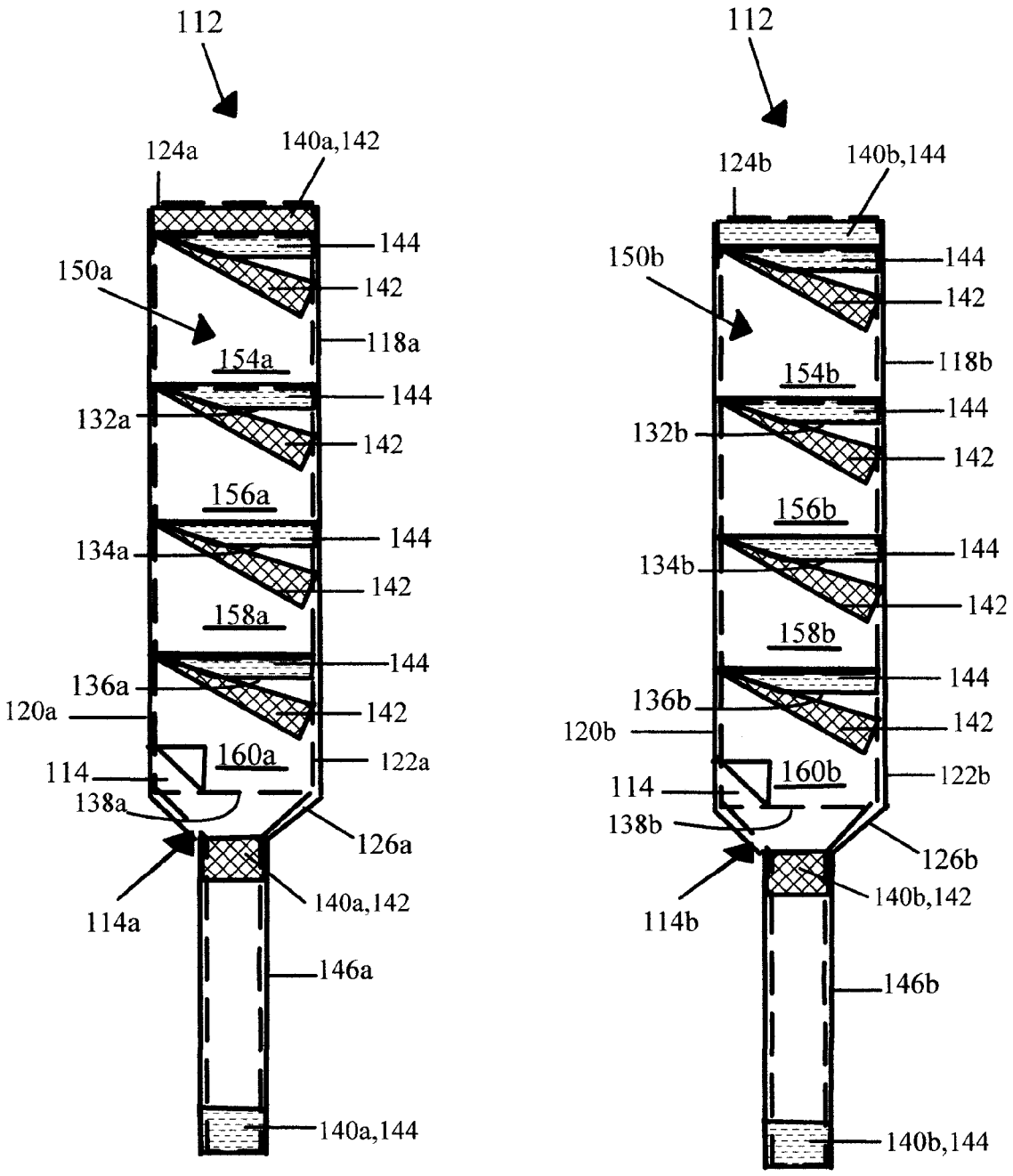

FIG. 3B gives a detailed posterior elevated view of the upper chamber attachments of the detachable reconfigurable modular pocket assemblage.

Figure 4A:
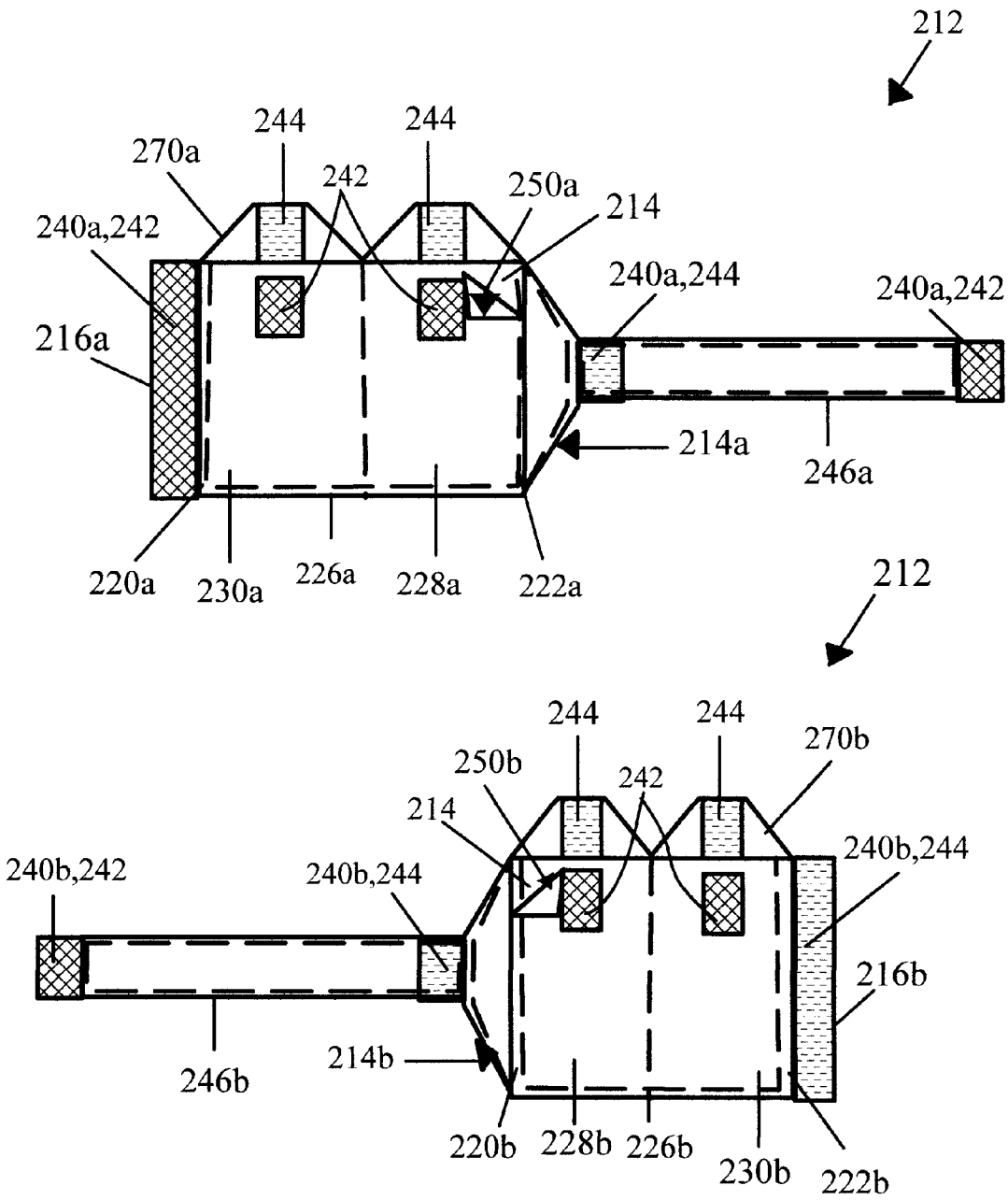

FIG. 4A gives a detailed anterior elevated view of the lower chamber attachments of the detachable reconfigurable modular pocket assemblage.

Figure 4B:
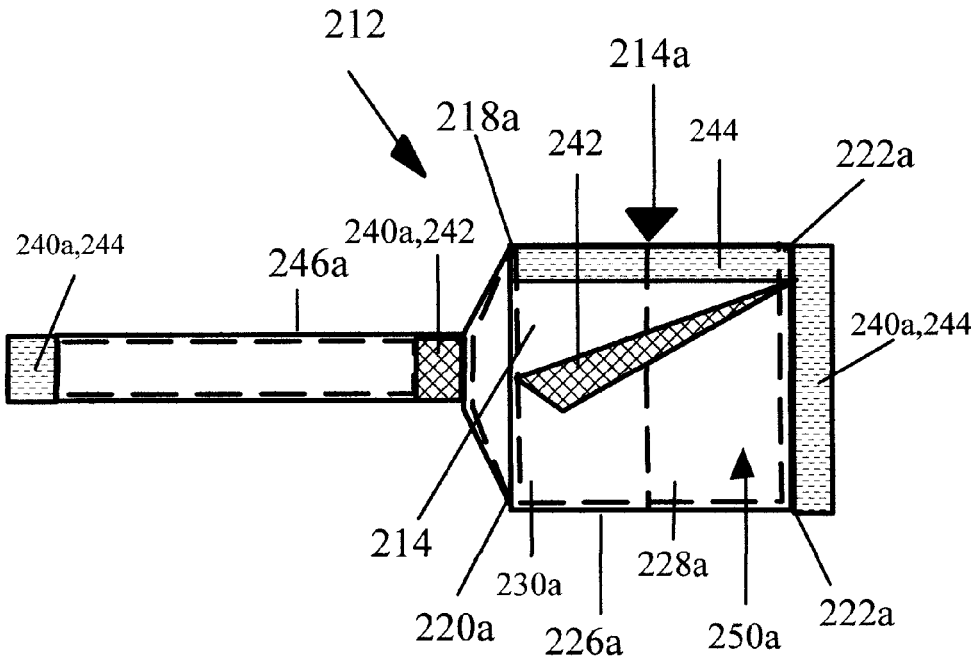
Figure 4B:
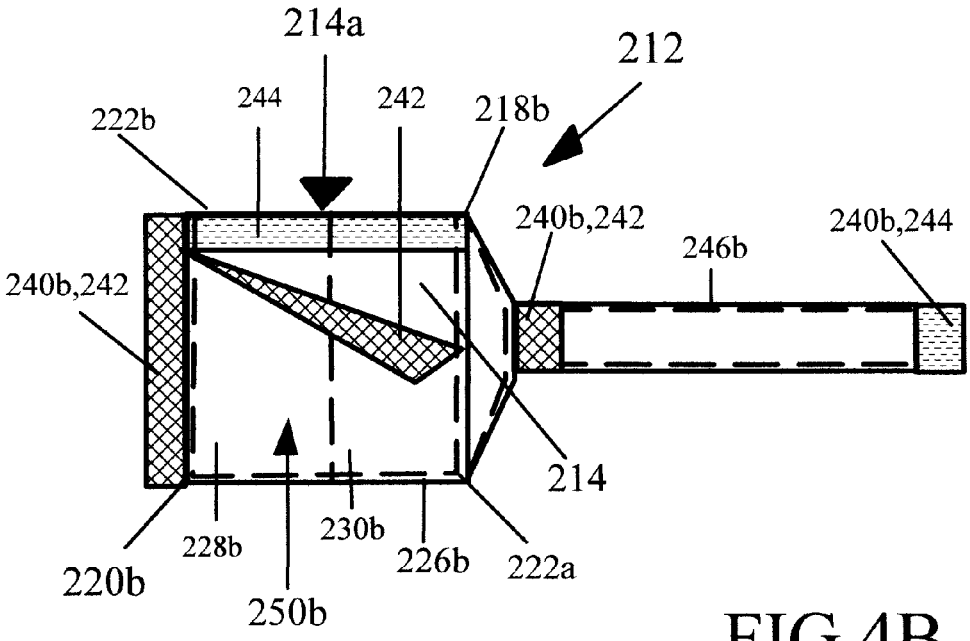

FIG. 4B gives a detailed posterior elevated view of the lower chamber attachments of the detachable reconfigurable modular pocket assemblage.

Figure 5A:
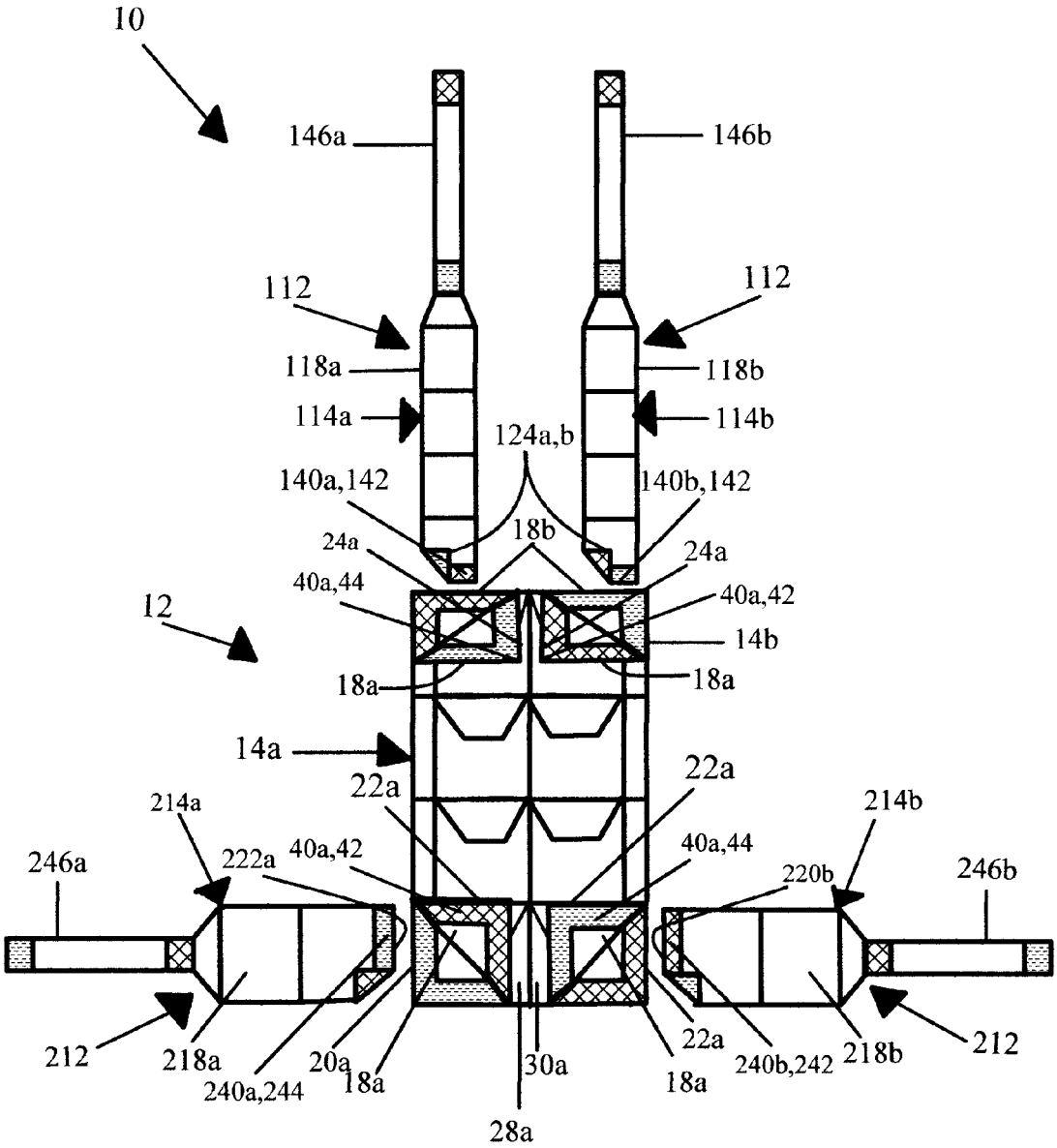

FIG. 5A illustrates an elevated anterior view of an unconnected layout of the chamber assemblage, the upper chambers attachment assemblage, and the lower chamber attachment assemblage.

Figure 5B:
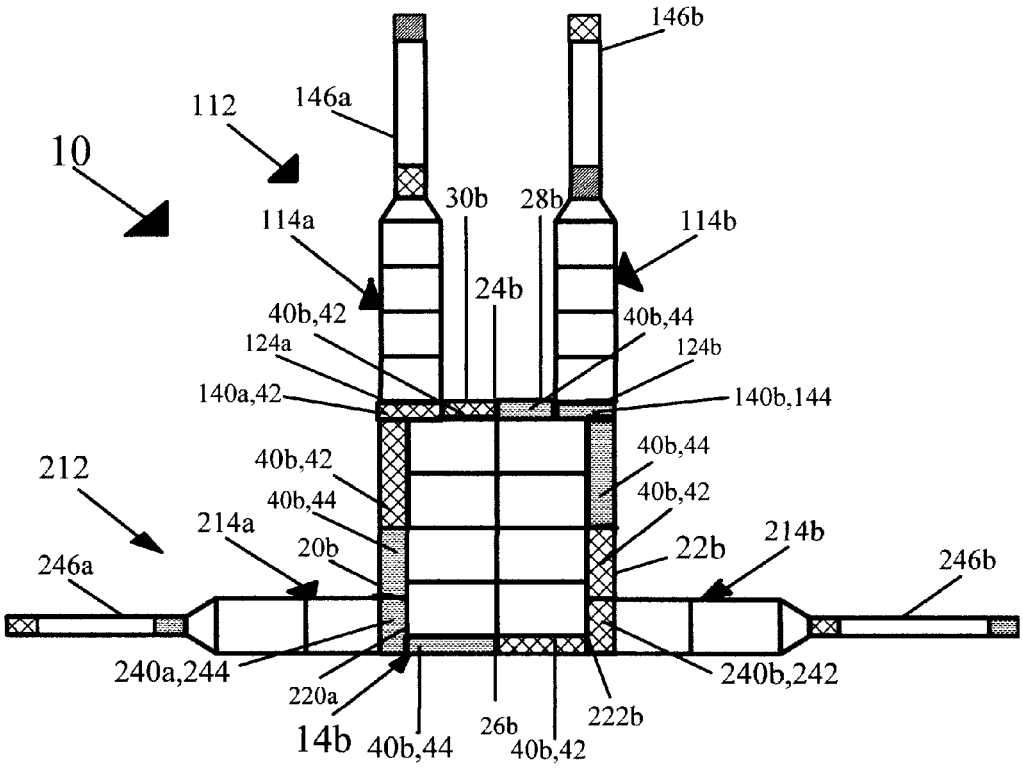
Figure 5B:
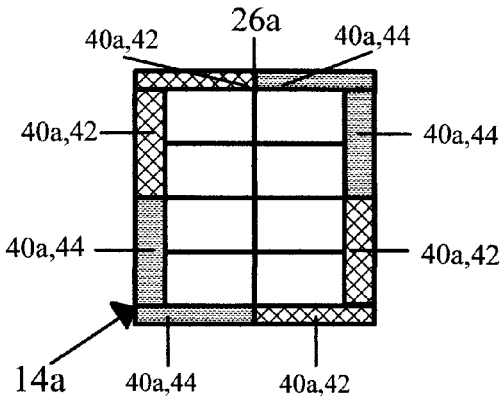

FIG. 5B gives a posterior view of a connected layout of the chamber assemblage, the upper chambers attachment assemblage, and the lower chamber attachment assemblage.

FIGS. 6A to 6M illustrates various configurations of the detachable reconfigurable modular pocket assemblage and an additional extension strap.

FIGS. 7A to 7G illustrates various configurations of the detachable reconfigurable modular pocket assemblage with changes in the chamber and the chamber attachments.

FIGS. 8A to 8E illustrates other embodiments with different shapes of the detachable reconfigurable modular pocket assemblage.

REFERENCE NUMERALS IN DRAWINGS

10 Detachable Reconfigurable Modular Pocket Assemblage
12 Chamber
14 Chamber Panels
14*a* chamber panel one
16*a* anterior side
18*a* posterior side
20*a* right periphery
22*a* left periphery
24*a* top periphery
26*a* bottom periphery
28*a* column one
30*a* column two
32*a* row one
34*a* row two
36*a* row three
38*a* row four
14*b* chamber panel two
16*b* anterior side
18*b* posterior side
20*b* right periphery
22*b* left periphery
24*b* top periphery
26*b* bottom periphery
28*b* column one
30*b* column two
32*b* row one
34*b* row two
36*b* row three
38*b* row four
40 Chamber Mating Assemblage
40*a* chamber panel one-mating attachments
40*b* chamber panel two-mating attachments
42 loop material
44 hook material
50 Chamber Pocket Panels
50*a* panel one-pocket panels
54*a* pocket one panel
56*a* pocket two panel
58*a* pocket three panel
60*a* pocket four panel
50*b* panel two-pocket panels
54*b* pocket one panel
56*b* pocket two panel
58*b* pocket three panel
60*b* pocket four panel
70 Chamber Pocket Flaps
70*a* panel one-pocket flaps
72*a* pocket flap one
74*a* pocket flap two
76*a* pocket flap three
78*a* pocket flap four
70*b* panel two-pocket flaps
72*b* pocket flap one
74*b* pocket two flap
76*b* pocket three flap
78*b* pocket four flap
82 Chamber Pocket Openings
112 Upper Chamber Attachments
114 Shoulder Panels
114*a* right shoulder strap
116*a* right anterior side
118*a* right posterior side
120*a* right periphery
122*a* left periphery
124*a* top periphery
126*a* bottom periphery
132*a* row one
134*a* row two
136*a* row three
138*a* row four
114*b* left shoulder strap
116*b* left anterior side
118*b* left posterior side
120*b* right periphery
122*b* left periphery
124*b* top periphery
126*b* bottom periphery
132*b* row one
134*b* row two
136*b* row three
138*b* row four
140 Shoulder Mating Attachments
140*a* right shoulder-mating attachment
140*b* left shoulder-mating attachment
142 loop material
144 hook material
146 Shoulder Extension Straps
146*a* right shoulder-extension strap
146*b* left shoulder-extension strap
150 Shoulder Pocket Panels
150*a* right pocket panels
154*a* pocket one panel
156*a* pocket two panel
158*a* pocket three panel
160*a* pocket four panel
150*b* left pocket panels
154*b* pocket one panel
156*b* pocket two panel
158*b* pocket three panel
160*b* pocket four panel
170 Shoulder Pocket Flaps
170*a* right pocket flaps
172*a* pocket flap one
174*a* pocket flap two
176*a* pocket flap three
178*a* pocket flap four
170*b* left pocket flaps
172*b* pocket flap one
174*b* pocket flap two
176*b* pocket flap three
178*b* pocket flap four
182 Shoulder Pocket Openings
212 Lower Chamber Attachments
214 Waist Panels
214*a* right waist strap
216*a* anterior side
218*a* posterior side
220*a* right periphery
222*a* left periphery
224*a* top periphery
226*a* bottom periphery
228*a* column one
230*a* column two
214*b* left waist strap
216*b* anterior side
218*b* posterior side
220*b* right periphery
222*b* left periphery

2246 top periphery
226*b* bottom periphery
2286 column one
230*b* column two
240 Waist Mating Attachments
240*a* right waist-mating attachment
240*b* left waist-mating attachment
242 loop material
244 hook material
246 Waist Extension Straps
246*a* right waist-extension strap
246*b* left waist-extension strap
250 Waist Pocket Panels
250*a* right pocket panel
250*b* left pocket panel
270 Waist Pocket Flaps
270*a* right pocket flap
270*b* left pocket flap
282 Waist pocket openings
290 Strap Fasteners
292*a* right buckle
294*b* left buckle release
29613 left buckle slide
300 Additional Straps
340 Additional Strap-Mating Attachments
342 loop material
344 hook material

SUMMARY OF THE PRESENT DISCLOSURE

The summary is not to identify key or essential concepts of the claimed subject matter, nor is it for determining the scope of the claimed subject matter.

In the illustrative embodiments of the present detachable reconfigurable pocket assemblages, there is a plurality of pockets for the insertion of therapeutic packs, weights, and general use items. To use the illustrated embodiments as therapeutic cooling or heating assemblages, the user inserts ice or heat packs into the pockets of the assemblages. To use the illustrated embodiments to strengthen muscles, the user inserts exercise weights into the pockets of the assemblages. Additionally, the illustrated embodiments become general use assemblages, when the user inserts items such as bottled water, sports drinks, cell phones, and a sundry of other items into the pockets of the assemblages.

The illustrative embodiments of the present pocket assemblages more particularly comprises; geometrically shaped chamber panels one and two with pockets, right and left chamber attachments with pockets, and a plurality of mating attachments.

DETAILED DESCRIPTION OF ILLUSTRATIVE EMBODIMENTS

The present pocket assemblages will now be described more fully with reference to the figures in which various views of the present disclosure are shown. The designs of the illustrated embodiments are flat, therefore only the anterior and posterior views are shown.

When the chamber panels one and two and the chamber attachments right and left are identical, they will be referenced together in the drawings, but described separately in a different paragraph. The reference letter (a) represents panel number one, and the letter (b) represents panel number two. When reference is made to the chamber attachments, the reference letter (a) represents the right, and the letter (b) represents the left.

When the components of the pocket assemblages have pocket panels on both the anterior and posterior sides, they can be secured together simultaneously, or the securing process is first done on the anterior side and the same process is repeated on the posterior side. A series of dashes are used to represent the securing process.

The sequence of securing will depend on the equipment used. In the following detailed descriptions, the anterior components will be secured first and then the posterior. A hot iron presser, sewing machine, stapler, or any other well-known mechanical device or method, can be used for securing the components of the detachable reconfigurable pocket assemblages together.

When referring to the placement of loops and hooks located on predetermined peripheries of the chamber panels, the chamber attachments, and the extension straps, the term mating attachment is used. Other releasable attachments well known in the art may also be used.

The subject matter of present pocket assemblages maybe embodied in many different forms and should not be construed as being limited to the illustrated embodiments of the present pocket assemblage set herein.

Description of the Referenced Embodiments

FIGS. 1A TO 6M

In the referenced pocket assemblages, the panels have identical configurations. In other embodiments, the panel configurations can be substantially similar, the difference being the number of pockets and pocket flaps, location of the pocket openings, and shape and size of the panels.

Figure 1A:
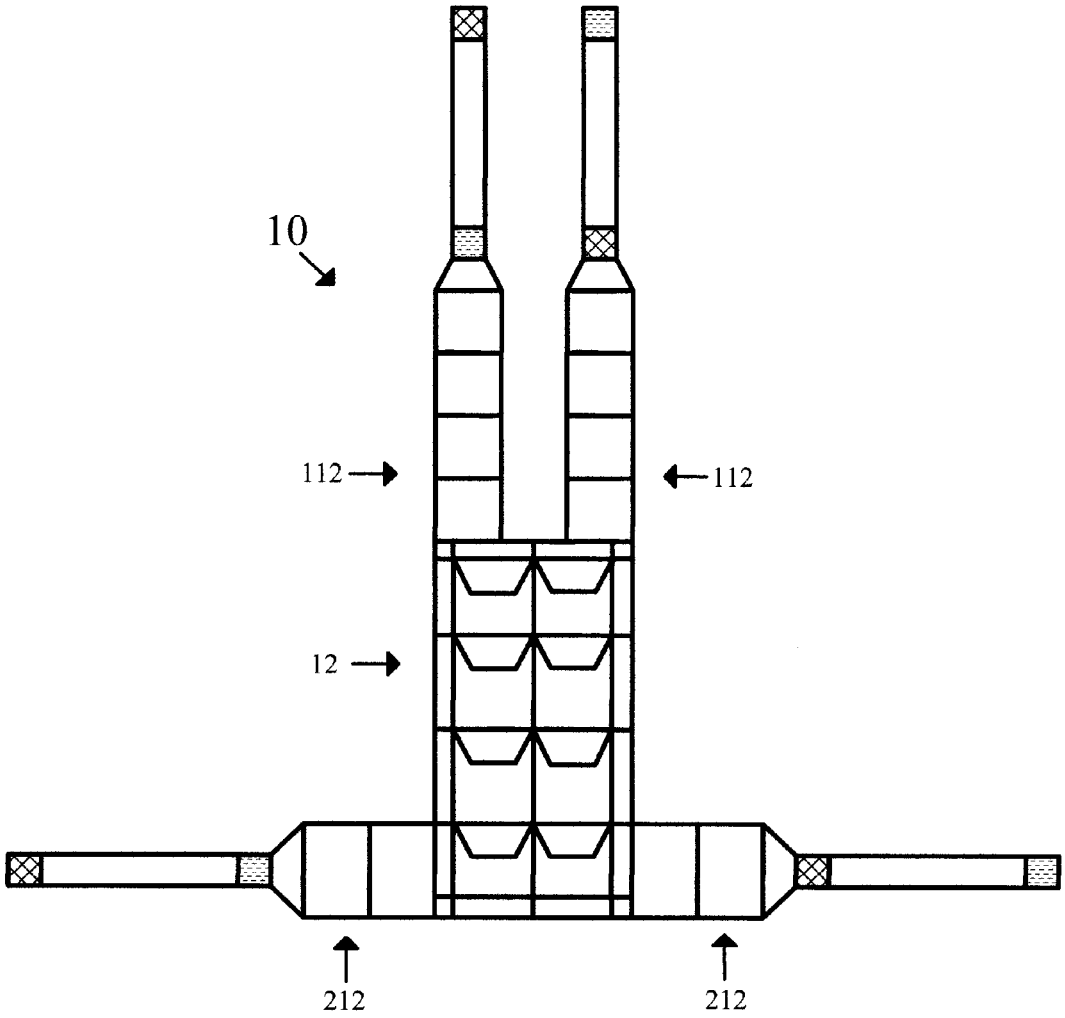

FIG. 1A illustrates an overall anterior view of a basic version of a detachable reconfigurable modular pocket assemblage 10. The main components are a detachable chamber 12, a pair of upper chamber attachments 112 and a pair of lower chamber attachments 212. The pocket assemblage 10 is made of flexible materials, such as vinyl, cloth fabrics, and other flexible materials well known in the art.

Figure 1B:
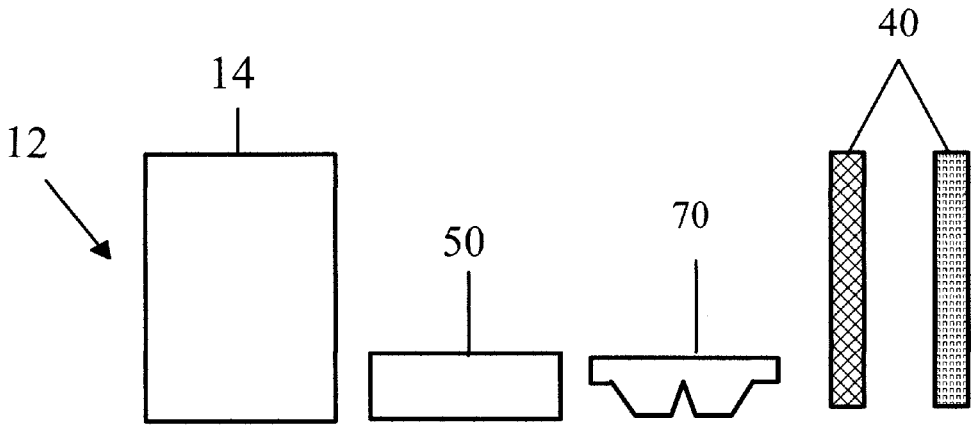

FIG. 1B provides a spread of the individual parts and shapes of the chamber 12. The parts comprise a chamber panel 14, a chamber pocket panel 50, a chamber pocket flap 70, and a set of releasable chamber mating attachments 40. The main purpose of the chamber mating attachments 40 is to provide a method for configurations. The chamber panel 14 has a rectangular shape, other shapes such as, hexagonal, octagonal, triangle, circular, heart or square could be used for the design of the chamber 12.

Figure 1C:
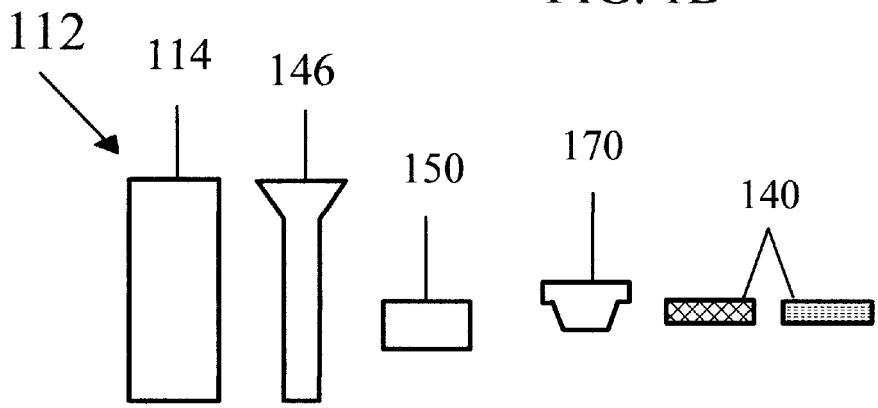

FIG. 1C provides a spread of the individual parts and shapes of the upper chamber attachment 112. The parts comprise a shoulder panel 114, a shoulder extension strap 146, a shoulder pocket panel 150, a shoulder pocket flap 170 and a set of shoulder-mating attachments 140. The main purpose of the mating attachments 140 is to provide a method for configurations.

Figure 1D:
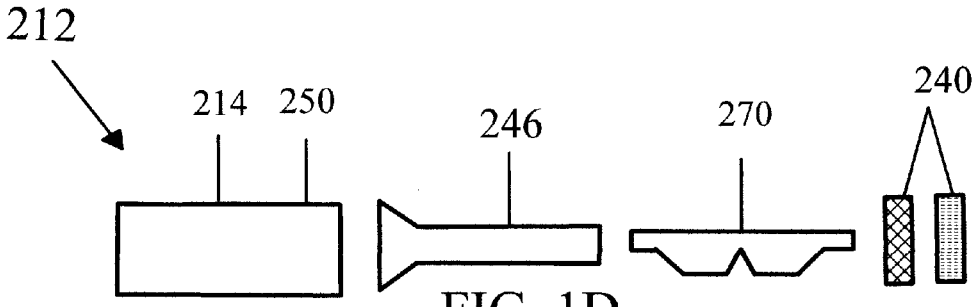

FIG. 1D provides a spread of the individual parts and shapes of the lower chamber attachment 212. The parts comprise a waist panel 214, a waist extension strap 246, a waist pocket flap 270, and a set of releasable waist mating attachments 240. The main purpose of the mating attachments 240 is to provide a method for configurations. A waist pocket panel 250 is not shown in the drawing since it has the same shape as the waist panel 214.

Figure 1E:
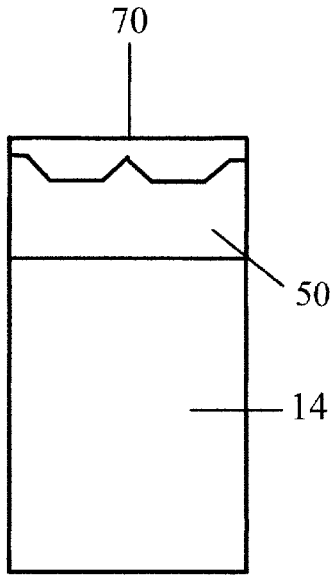

FIG. 1E shows one of the chamber pocket panels 50, and one of the chamber pocket flaps 70 placed on one of the chamber panels 14. There is more than one chamber panel 14, chamber pocket panel 50, and chamber pocket flap 70, only one of each is shown in the drawings since the others have the same identical shape. In other embodiments, the chamber panel 14 is large enough to be folded, and serve the duel purpose of being used as the chamber pocket panel 50, with no chamber pocket flaps 70.

Figure 1F:
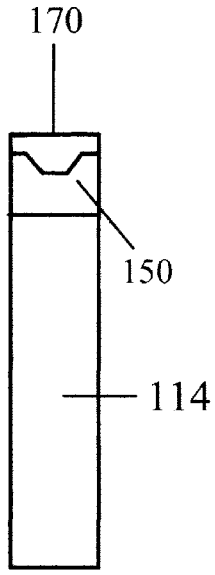

FIG. 1F shows one of the shoulder pocket panels 150, and one of the shoulder pocket flaps 170 placed on one of the shoulder panels 114. There is more than one shoulder panel 114, shoulder pocket panel 150 and shoulder pocket flap 170, only one of each is shown in the drawings since the others have the same identical shape. In other embodiments, the shoulder panel 114 is large enough to be folded, and serve the duel purpose of being used as the shoulder pocket panel 150, with no shoulder pocket flaps 170.

Figure 1G:
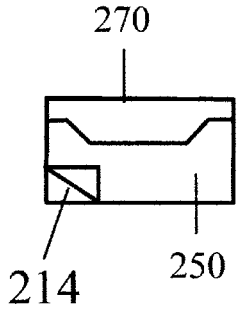

FIG. 1G shows one of the waist pocket panels 250, and one of the waist pocket flaps 270 placed on one of the waist panels 214. There is more than one waist panel 214, waist pocket panel 250 and waist pocket flap 270, only one of each is shown in the drawings since the others have the same identical shape. In other embodiments, the waist panel 214 is large enough to be folded, and serve the duel purpose of being used as the waist pocket panel 250, with no waist pocket flaps 270.

Description

FIGS. 2A, 2B, 2C, 2D, 2E, 2F, 2G, AND 2H

Using the components shown in FIG. 1B the chamber 12 is constructed. When the chamber pocket panel 50 is used for attachment to the chamber panel 14 it is identified as a panel one-pocket panel 50*a*, and a left panel two-pocket panel 50*b*. When the mating attachment 40 is used for attachment to the chamber panel 14 it is identified as a chamber panel one-mating attachment 40*a*, and a chamber panel two-mating attachment 40*b*. When the chamber pocket flap 70 is used for attachment to the chamber panel 14 it is identified as a panel one-pocket flap 70*a*, and a panel two-pocket flap 70*b*. Although it is shown in the drawings, that the chamber pocket flap 70 and the chamber pocket panel 50 are separate pieces they can be combined and formed as a single piece.

FIG. 2A illustrates an anterior side 16*a* of a chamber panel one 14*a*, and an anterior side 16*b* of a chamber panel two 14*b*, with panel one-pocket panels 50*a* and panel two-pocket panels 50*b*.

The panel one-pocket panels 50*a* are identified as: a pocket one panel 54*a*, a pocket two panel 56*a*, a pocket three panel 58*a*, and a pocket four panel 60*a*. Attached to pocket panels 54*a*, 56*a*, 58*a*, and 60*a* are the panel one-pocket flaps 70*a*. The chamber pocket flaps 70*a* are identified as a pocket flap one 72*a*, a pocket flap two 74*a*, a pocket flap three 76*a*, and a pocket flap four 78*a*.

The number of panel two-pocket panels 50*b* are identified as: a pocket one panel 54*b*, a pocket two panel 56*b*, a pocket three panel 58*b*, and a pocket four panel 60*b*. Attached to pocket panels 54*b*, 56*b*, 58*b*, and 60*b* are the panel two-pocket flaps 70*b*. The chamber pocket flaps 70*b* are identified as a pocket flap one 72*b*, a pocket flap two 74*b*, a pocket flap three 76*b*, and a pocket flap four 78*b*.

FIG. 2B illustrates a posterior side 18*a* of the chamber panel one 14*a*, and a posterior side 18*b* of the chamber panel two 14*b*. In the present embodiment, there are no pocket flaps 70 on the posterior sides 18*a* and 18*b*.

On the posterior side 18*a* of the chamber panel one 14*a* are the panel one-pocket panels 50*a*: pocket one panel 54*a*, pocket two panel 56*a*, pocket three panel 58*a*, and pocket four panel 60*a*.

On the posterior side 18*b* of the chamber panel two 14*b* are the panel two-pocket panels 50*b*: pocket one panel 54*b*, pocket two panel 56*b*, pocket three panel 58*b*, and pocket four panel 60*b*.

FIG. 2C illustrates an anterior view of chamber panels 14*a* and 14*b*, and the placement of a plurality of loops 42 and a plurality of hooks 44 on the pocket panels 50*a*, and 50*b*.

First, hooks 44 and loops 42 are attached to the components on the anterior side 16*a* of chamber panel 14. Hooks 44 are attached to the backside of pocket flaps 72*a*, 74*a*, 76*a*, and 78*a*, which are in alignment with loops 42 that are attached to the front of pocket panels 54*a*, 56*a*, 58*a*, and 60*a*.

Next, hooks 44 and loops 42 are attached to the components on the anterior side 16*b* of chamber panel 14. Hooks 44 are attached to the backside of pocket flaps 72*b*, 74*b*, 76*b*, and 78*b*, which are in alignment with loops 42 that are attached to the front of pocket panels 54*b*, 56*b*, 58*b*, and 60*b*.

FIG. 2D illustrates a posterior view of chamber panels 14*a* and 14*b*, and the placement of a plurality of loops 42 and a plurality of hooks 44 on the pocket panels 50*a*, and 50*b*.

First, hooks 44 and loops 42 are attached to the components on the posterior side 18*a* of chamber panel 14. On the backside of chamber panel one 14*a*, there is hook 44, which is in alignment with loop 42 on the top backside of pocket panel one 54*a*. On the bottom front of pocket one panel 54*a*, there is hook 44 that is in alignment with loop 42 on the top backside of pocket panel two 56*a*. On the bottom front of pocket panel two 56*a*, there is hook 44 that is in alignment with loop 42 on the top backside of pocket panel three 58*a*. On the bottom front of pocket panel three 58*a* there is hook 44 that is in alignment with loop 42 on the top backside of pocket panel four 60*a*.

Next, hooks 44 and loops 42 are attached to the components on the posterior side 18*b* of chamber panel 14. On the backside of the chamber panel two 14*b* there is the hook 44, which is in alignment with the loop 42 on the top backside of pocket panel one 54*b*. On the bottom front of pocket one panel 54*b*, there is the hook 44 that is in alignment with the loop 42 on the top backside of pocket panel two 56*b*. On the bottom front of pocket panel two 56*b*, there is the hook 44 that is in alignment with the loop 42 on the top backside of pocket panel three 58*b*. On the bottom front of pocket panel three 58*b* there is hook 44 that is in alignment with the loop 42 on the top backside of pocket panel four 60*b*.

FIG. 2E illustrates an anterior view of d how the components of the chamber panels 14*a* and 14*b* are secured together, for the purpose of making a plurality of rows and columns.

First, the securing process is done on the anterior 16*a* side of chamber panel one 14*a*. Pocket flap one 72*a* is secured horizontally across a top periphery 24*a*. Secured vertically down to a right periphery 20*a* and a left periphery 22*a* of the chamber panel one 14*a* is the pocket one panel 54*a* with the pocket flap two attached 74*a*. Secured vertically down to the right periphery 20*a* and the left periphery 22*a* of the chamber panel one 14*a* is the pocket two panel 56*a* with the pocket flap three attached 76*a*. Secured vertically down to the right periphery 20*a* and the left periphery 22*a* of the chamber panel one 14*a* is the pocket three panel 58*a* with the pocket flap four attached 78*a*. Secured vertically down to the right periphery 20*a* and the left periphery 22*a* of the chamber panel one 14*a* is the pocket four panel 60*a*. Securing vertically down the center a column one 28*a*, and a column two 30*a* are made into the chamber panel one 14*a*. Securing horizontally across, just above the pocket flaps 74*a*, 76*a*, and 78*a*, a row one 32*a*, a row two 34*a*, and a three row 36*a*, are made into the chamber panel one 14*a*. Securing horizontally across a bottom periphery 26*a* a row four 38*a* is made into the chamber panel one 14*a*.

Next, the securing process is done on the anterior side 16*b* of chamber panel two 14*b*. The pocket flap one 72*b* is secured horizontally across a top periphery 24*b*. Secured vertically down to a right periphery 20*b* and a left periphery 22*b* of the chamber panel two 14*b* is the pocket one panel 54*b* with the pocket flap two attached 74*b*. Secured vertically down to the right periphery 20*b* and the left periphery 22*b* of the chamber panel two 14*b* is the pocket two panel 56*b* with the pocket flap three attached 76*b*. Secured vertically down to the right periphery 20*b* and the left periphery 22*b* of the chamber panel two 14*b* is the pocket three panel 58*b* with the pocket flap four attached 78*b*. Secured vertically down to the right periphery 20*b* and the left periphery 22*b* of the chamber panel two 14*b* is the pocket four panel 60*b*. Securing vertically down the center a column one 28*b*, and a column two 30*b* are made into the chamber panel two 14*b*. Securing horizontally across, just above the pocket flaps 74*b*, 76*b*, and 78*b*, a row one 32*b*, a row two 34*b*, and a three row 36*b* are made into the chamber panel two 14*b*. Securing horizontally across a bottom periphery 26*b* a row four 38*b* is made into the chamber panel one 14*b*.

FIG. 2F illustrates a posterior view of how the components of the chamber panels 14*a* and 14*b* are secured together, for the purpose of making a plurality of rows and columns.

First, the securing process is done on the posterior side 18*a* of chamber panel one 14*a*. Secured vertically down to the right periphery 20*a* and the left periphery 22*a* of the chamber panel one 14*a* is the pocket one panel 54*a*. Secured vertically down to the right periphery 20*a* and the left periphery 22*a* of the chamber panel one 14*a* is the pocket two panel 56*a*. Secured vertically down to the right periphery 20*a* and the left periphery 22*a* of the chamber panel one 14*a* is the pocket three panel 58*a*. Secured vertically down to the right periphery 20*a* and the left periphery 22*a* of the chamber panel one 14*a* is the pocket four panel 60*a*. Securing vertically down the center, column one 28*a*, and column two 30*a* are made into the chamber panel one 14*a*. Securing horizontally across the bottom of pocket panels 54*a*, 56*a*, 58*a*, and 60*a* row one 32*a*, row two 34*a*, three row 36*a* and row four 38*a* are made into the chamber panel one 14*a*.

Next, the securing process is done on the posterior side 18*b* of chamber panel two 14*b*. Secured vertically down to the right periphery 20*b* and the left periphery 22*b* of the chamber panel two 14*b* is the pocket one panel 54*b*. Secured vertically down to the right periphery 20*b* and the left periphery 22*b* of the chamber panel two 14*b* is the pocket two panel 56*b*. Secured vertically down to the right periphery 20*b* and the left periphery 22*b* of the chamber panel two 14*b* is the pocket three panel 58*b*. Secured vertically down to the right periphery 20*b* and the left periphery 22*b* of the chamber panel two 14*b* is the pocket four panel 60*b*. Secured horizontally across to the bottom periphery 26*b* of the chamber panel two 14*b* is the pocket four panel 60*b*. Securing vertically down the center column one 28*b*, and column two 30*b* are made into the chamber panel two. Securing horizontally across, row one 32*b*, row two 34*b*, three row 36*b*, and row four 38*b* are made into the chamber panel two 14*b*.

FIG. 2G shows the placement of a chamber mating assemblage 40 on the posterior side 18*a* and 18*b* of the chamber panel one 14*a* and 14*b*. In this embodiment loops 42 and hooks 44 are used. Other attachments known in the art may also be used. A plurality of chamber panel one-mating attachments 40*a* and a plurality of chamber panel two-mating attachments 40*b* are for connecting the peripheries, and for providing more than one closeable entry along the chamber panel one 14*a* and the chamber panel two 14*b* peripheries, and for reconfigurations.

First, chamber mating attachments 40*a* are secured to the chamber panel one 14*a*. Permanently secured to the right periphery 20*a*, the left periphery 22*a*, the top periphery 24*a*, and the bottom periphery 26*a* are the chamber panel one-mating attachments 40*a*. Located on the right periphery 20*a*, column two 30*a*, row one 32*a*, and row two 34*a* are the loops 42, located on row three 36*a* and row four 38*a* are the hooks 44. Located on the left periphery 22*a*, column one 28*a* row one 32*a*, and row two 34*a* are the hooks 44, located at row three 36*a*, and row four 38*a*, are the loops 42. Located on the top periphery 24*a* column two 30*a*, is the loop 42 located at column one 28*a* is the hook 44. Located on the bottom periphery 26*a* column two 30*a* is the hook 44, located column one 28*a* is the loop 42.

Next, chamber mating attachments 40*b* are secured to the chamber panel two 14*b*. Permanently secured to the right periphery 20*b*, the left periphery 22*b*, top periphery 24*b*, and the bottom periphery 26*b* are the chamber panel two-mating attachments 40*b*. Located on the right periphery 20*b*, column two 30*b*, row one 32*b*, and row two 34 are the loops 42, located on row three 36*b* row four 38*b*, is the hook 44. Located on the left periphery 22*b*, columns one 28*b* row one 32*b*, and row two 34*b* are the hooks 44, located at row three 36*b*, and row four 38*b*, are the loops 42. Located on the top periphery 24*b* column two 30*b*, is the loop 42 located at column two 28*b* is the hook 44. Located on the bottom periphery 26*b* column two 30*b* is the hook 44, located column one 28*b* is the loop 42.

FIG. 2H gives a view of how the chamber mating assemblage 40 on the chamber panel one 14*a* is aligned with the chamber mating assemblage 40 on the chamber panel two 14*b*.

The mating attachments 40*a* loops 42 and hooks 44 on the posterior side 18*a* of the chamber panel one's 14*a* peripheries 20*a*, 22*a*, 24*a*, and 26*a*, are aligned with the opposing mating attachments 40*b* loops 42 and hooks 44 on the posterior side 18*b* of chamber panel two's 14*b* peripheries 20*b*, 22*b*, 24*b*, and 26*b*.

When the peripheries 20*b*, 22*b*, 24*b*, and 26*b* of the chamber panel two 14*b* is placed on top of the chamber panel one's 14*a* peripheries 20*a*, 22*a*, 24*a* and 26*a* the modular detachable chamber 12 is formed.

FIGS. 3A, 3B

Using the components shown in FIG. 1C the upper chamber attachment 112 is constructed. When the shoulder pocket panel 150 is used for attachment to the shoulder panel 114 it is identified as a right pocket panel 150*a*, and a left pocket panel 150*b*. When the mating attachment 140 is used for attachment to the shoulder panel 114 it is identified as a right shoulder-mating attachment 140*a*, and a left shoulder-mating attachment 140*b*. The main purposes of the mating attachments 140*a* and 140*b*, are for attaching the shoulder straps 114*a* and 114*b* to the peripheries on the chamber panels 14*a* and 14*b*, and for reconfigurations. When the shoulder pocket flap 170 is used for attachment to the shoulder panel 114 it is identified as a right pocket flap 170*a*, and a left pocket flap 170*b*. When the shoulder extension strap 146 is used for attachment to the shoulder panel 114 it is identified as a right shoulder-extension strap 146*a*, and a left shoulder-extension strap 146*b*. The main purposes of the shoulder extension strap 146*a* and 146*b* are for adjusting, sizing and reconfigurations. Although it is shown in the drawings that the shoulder pocket flap 170 and the shoulder pocket panel 150 are separate pieces they can be combined and formed as a single piece. In the present pocket assemblage, the right shoulder-extension strap 146*a* and the left shoulder-extension strap 146*b* are connected by tying them together. In other embodiments, hooks and loops, cap-socket and stud combination, buckles, and other well known items in the art maybe used.

FIG. 3A gives a detailed anterior view of the upper chamber attachments 112 and their components. Illustrated are a right shoulder strap 114*a* and a left shoulder strap 114*b*. The shoulder straps 114*a* and 114*b* are identical except for the mating attachments 140*a* and 140*b* on the top periphery 124*a* and 124*b*.

First, the right shoulder strap 114*a* is constructed. The construction of an anterior side 116*a* of the right shoulder strap 114*a* involves the use of the right pocket panels 150*a* being attached to the shoulder panel 114. The right pocket panels 150*a* comprises: a pocket one panel 154*a*, a pocket two panel 156*a*, a pocket three panel 158*a*, and a pocket four panel 160*a*. Attached to pocket panels 154*a*, 156*a*, 158*a*, and 160*a* are the shoulder pocket flaps 170*a*. The plurality of pocket flaps used are identified as a pocket flap one 172*a*, a pocket flap two 174*a*, a pocket flap three 176*a*, and a pocket flap four 178*a*.

Overlapping pocket one panel 154*a* is pocket flap one 172*a*, attached to the backside of the flap 172*a* is hook 144. Attached to pocket one panel 154*a* is loop 142, which is in alignment with hook 144. Overlapping pocket two panel 156*a* is pocket flap two 174*a* attached to the backside of the flap 174*a* is hook 144. Attached to pocket two panel 156*a* is loop 142, which is in alignment with hook 144. Overlapping pocket three panel 158*a* is pocket flap three 176*a* attached to the backside of flap 176*a* is hook 144. Attached to pocket three panel 158*a* is loop 142, which is in alignment with hook 144. Overlapping pocket four panel 160*a* is pocket flap four 178*a* attached to the backside of flap 178*a* is hook 144. Attached to pocket four panel 160*a* is loop 142, which is in alignment with hook 144.

Located on the shoulder panel's 114 anterior side 116*a* top periphery 124*a* is the permanently attached mating attachments 140. The mating attachment is a hook 144.

Attached to the pocket four panel 160*a* is the right shoulder-extension strap 146*a*. Located on the right shoulder-extension strap 146*a* is the mating attachments 140*a* loop 142 and hook 144. The pocket panels 154*a*, 156*a*, 158*a*, 160*a* and the extension strap 146*a* are secured to the right anterior side 116*a* of the shoulder panel 114. The pocket flap one 172*a* is secured horizontally across a top periphery 124*a*. Pocket one panel 154*a* with pocket flap one 172*a* is secured vertically down a right periphery 120*a*, and a left periphery 122*a*. Pocket two panel 156*a* with pocket flap two 174*a*, is secured vertically down the right periphery 120*a*, and the left periphery 122*a*. Pocket three panel 158*a* with pocket flap three 176*a* is secured vertically down the right periphery 120*a*, and the left periphery 122*a*. Pocket four panel 160*a* with pocket flap four 178*a* is secured vertically down the right periphery 120*a* left periphery 122*a*. Securing horizontally across, just above the pocket flaps 174*a*, 176*a*, and 178*a*, a row one 132*a*, a row two 134*a*, and a three row 136*a*, are made into the shoulder panel 114. Securing horizontally across a bottom periphery 126*a* a row four 138*a* is made into the shoulder panel 114. The result of the securing process is the development of the anterior side 116*a* of the right shoulder strap 114*a*.

Next, the left shoulder strap 114*b* is constructed. The construction of an anterior side 116*b* of the left shoulder strap 114*b* involves the use of left pocket panels 150*b* being attached to the shoulder panel 114. The left pocket panels 150*b* comprises: a pocket one panel 154*b*, a pocket two panel 156*b*, a pocket three panel 158*b*, and a pocket four panel 160*b*. Attached to pocket panels 154*b*, 156*b*, 158*b*, and 160*b* are the shoulder pocket flaps 170. The plurality of pocket flaps used are identified as a pocket flap one 172*b*, a pocket flap two 174*b*, a pocket flap three 176*b*, and a pocket flap four 178*b*.

Overlapping pocket one panel 154*b* is pocket flap one 172*b*, attached to the backside of the flap 172*b* is the hook 144. Attached to pocket one panel 154*b* is the loop 142, which is in alignment with the hook 144. Overlapping the pocket two panel 156*b* is pocket flap two 174*b* attached to the backside of the flap 174*b* is the hook 144. Attached to the pocket two panel 156*b* is the loop 142, which is in alignment with the hook 144. Overlapping pocket three panel 158*b* is pocket flap three 176*b* attached to the backside of the flap 176*b* is the hook 144. Attached to pocket three panel 158*b* is the loop 142, which is in alignment with the hook 144. Overlapping the pocket four panel 160*b* is pocket flap four 178*b* attached to the backside of the flap 178*b* is the hook 144. Attached to pocket four panel 160*b* is the loop 142, which is in alignment with the hook 144. Located on the shoulder panel's 114 anterior side 116*b* top periphery 124*b* is the permanently attached mating attachment 140. The mating attachment is the loop 142.

Attached to the pocket, four panel 160*b* is the left shoulder-extension strap 146*b*. Located on the left shoulder-extension strap 146*b* is the mating attachments 140*b* loop 142 and hook 144. The pocket panels 154*b*, 156*b*, 158*b*, 160*b* and the left shoulder-extension strap 146*b* are secured to the left anterior side 11613 of the shoulder panel 114. The pocket flap one 172*b* is secured horizontally across a top periphery 124*b*. Pocket one panel 154*b* with pocket flap one 172*b* is secured vertically down a right periphery 120*b*, and the left periphery 122*a*. Pocket two panel 156*b* with pocket flap two 174*b*, is secured vertically down the right periphery 120*b*, and a left periphery 122*b*. Pocket three panel 158*b* with pocket flap three 176*b* is secured vertically down the right periphery 120*b*, and the left periphery 122*b*. Securing horizontally across, just above the pocket flaps 174*b*, 176*b*, and 178*b*, a row one 132*b*, a row two 134*b*, and a three row 136*b*, are made into the shoulder panel 114. Securing horizontally across a bottom periphery 126*b* a row four 138*b* is made into the shoulder panel 114. The result of the securing process is the development of the anterior side 116*b* of the left shoulder strap 114*b*.

FIG. 3B gives a detailed posterior view of the upper chamber attachment 112. Illustrated are the right shoulder strap 114*a* and 114*b*. The shoulder straps 114*a* and 114*b* are identical except for the mating attachments 140*a* and 140*b* on the top periphery 124*a* and 124*b*.

First, the shoulder strap 114*a* is constructed. The construction of a posterior side 118*a* of the right shoulder strap 114*a* involves the use of right pocket panels 150*a* being attached to the shoulder panel 114. The right panels 150*a* comprises: a pocket one panel 154*a*, a pocket two panel 156*a*, a pocket three panel 158*a*, and a pocket four panel 160*a*. Attached to the pocket, four panel 160*a* is a right shoulder-extension strap 146*a*.

On the backside of shoulder panel one 114 there is the hook 144, which is in alignment with the loop 142 on the inside top back of pocket panel one 154*a*. On the bottom front of pocket one panel 154*a* there is the hook 144 that is in alignment with the loop 142 on the inside top back of pocket panel two 156*a*. On the bottom front of pocket panel two 156*a*, there is the hook 144 that is in alignment with the loop 142 on the inside top back of pocket panel three 158*a*. On the bottom front of pocket panel three 158*a* there is hook 144 that is in alignment with the loop 142 on the inside top back of pocket panel four 60*a*.

Located on the shoulder panel's 114 posterior side 118*a*, top periphery 124*a* is the permanently attached mating attachment 140*a* loop 142. Located on the right shoulder-extension strap 146*a* is the mating attachments 140*a* loop 142 and hook 144.

The pocket panels 154*a*, 156*a*, 158*a*, 160*a* and the extension strap 146*a* are secured to the posterior side 118*a* of the shoulder panel 114. Pocket one panel 154*a* is secured vertically down the right periphery 120*a*, and the left periphery 122*a*. Pocket two panel 156*a* is secured vertically down the right periphery 120*a*, and the left periphery 122*a*. Pocket three panel 158*a* is secured vertically down the right periphery 120*a*, and the left periphery 122*a*. Pocket four panel 160*a* is secured vertically down the right periphery 120*a* left periphery 122*a*. Securing horizontally across the bottom of pocket panels 154*a*, 156*a*, 158*a*, and 160*a* row one 132*a*, row two 134*a*, three row 136*a* and row four 138*a* are made into the shoulder panel one 114. The result of the securing process is the development of the posterior side 118*a* of the right shoulder strap 114*a*.

Next, the left shoulder strap is constructed 114*b*. The construction of a posterior side of the 118*b* left shoulder strap 114*b* involves the use of left pocket panels 150*b* being attached to the shoulder panel 114. The left pocket panel 150*b* comprises a pocket one panel 15413, a pocket two panel 156*b*, a pocket three panel 158*b*, and a pocket four panel 160*b*. Attached to the pocket, four panel 160*b* is a left shoulder-extension strap 146*b*.

On the backside of shoulder panel one 114 there is the hook 144, which is in alignment with the loop 142 on the inside top back of pocket panel one 154*b*. On the bottom front of pocket one panel 154*b* there is the hook 144 that is in alignment with the loop 142 on the inside top back of pocket panel two 156*b*. On the bottom front of pocket panel two 156*b*, there is the hook 144 that is in alignment with the loop 142 on the inside top back of pocket panel three 158*b*. On the bottom front of pocket panel three 158*b* there is hook 144 that is in alignment with the loop 142 on the inside top back of pocket panel four 160*b*.

Located on the shoulder panel's 114 posterior side 118*b* top periphery 124*b* is the permanently attached mating attachments 140*b*. The mating attachment is the hook 144. Located on the left shoulder-extension strap 146*b* is the mating attachments 140 loop 142 and hook 144.

The pocket panels 154*b*, 156*b*, 158*b*, 160*b* and the extension strap 146*b* are secured to posterior side 118*b* of the shoulder panel 114. Pocket one panel 154*b* is secured vertically down the right periphery 120*b*, and the left periphery 122*b*. Pocket two panel 156*b* is secured vertically down the right periphery 120*b*, and the left periphery 122*b*. Pocket three panel 158*b* is secured vertically down the right periphery 120*b*, and the left periphery 122*b*. Pocket four panel 160*b* is secured vertically down the right periphery 120*b* left periphery 122*b*. Securing horizontally across the bottom of pocket panels 154*b*, 156*b*, 158*a*, and 160*b* row one 132*b*, row two 134*b*, three row 136*b* and row four 138*b* are made into the shoulder panel one 114. The result of the securing process is the development of the posterior side 118*b* of the left shoulder strap 114*b*.

FIGS. 4A, 4B

Using the components shown in FIG. 1D the lower chamber attachment 212 is constructed. When the waist pocket panel 250 is used for attachment to the waist panel 214 it is identified as a right pocket panel 250*a*, and a left pocket panel 250*b*. When the mating attachment 240 is used for attachment to the waist panel 214 it is identified as a right waist-mating attachment 240*a*, and a left waist-mating attachment 240*b*. The main purposes of the mating attachments 240, are for attaching the waist strap 214*a* and 214*b* to the peripheries on the chamber panels 14*a* and 14*b*, and for reconfigurations. When the waist pocket flap 270 is used for attachment to the waist panel 214 it is identified as a right pocket flap 270*a*, and a left pocket flap 270*b*. When the waist extension strap 246 is used for attachment to the waist panel 114 it is identified as a right waist-extension strap 246*a*, and a left waist-extension strap 246*b*. The main purposes of the waist extension strap 246*a* and 246*b* are for adjusting, sizing and reconfigurations. Although it is shown in the drawings that the waist pocket flap 270 and the waist pocket panel 250 are separate pieces they can be combined and formed as a single piece. In the present pocket assemblage, the right waist-extension strap 246*a* and the left waist-extension strap 246*b* are connected by tying them together. In other embodiments, hooks and loops, cap-socket and stud combination, buckles, and other well known items in the art maybe used.

FIG. 4A gives a detailed anterior view of the lower chamber attachments 212. Illustrated are a right waist strap 214*a* and a left waist strap 214*b*. The waist straps 214*a* and 214*b* are identical except for the mating attachments 240*a* and 240*b* on the right periphery 220*a* and left periphery 222*b*.

First, the right waist strap 214*a* is constructed. The construction of an anterior side 216*a* of the right waist strap 214*a* involves the following process: The right pocket panel 250*a*, and the extension strap 246*a* are secured to the anterior side 216*a* of the waist panel 214.

Overlapping the right pocket panel 250*a*, is a right pocket flap 270*a*, attached to the backside of the flap 270*a*, are the hooks 244, attached to the right pocket panel 250*a*, are the loops 242, which is in alignment with the hooks 244. The waist extension strap 246*a* is secured to the right pocket panel 250*a*.

Located on the waist panel's 214 anterior side 216*a*, the right periphery 220*a* is the permanently attached mating attachment 240*a* loop 242. Located on the right waist-extension strap 246*a* is the mating attachments 240*a* loop 242 and hook 244.

The waist panel 214 and the waist pocket panel 250*a* are secured together vertically down a right periphery 220*a*, a bottom periphery 226*a* and a left periphery 222*a*. Securing vertically down the center of the waist pocket panel 250*a* a column one 228*a* and a column two 230*a* is made. The result of the securing process is the development of the right waist strap 214*a*.

Next, the left waist strap 214*b* is constructed. The construction of an anterior side 216*b* of the left waist strap 214*b* involves the following process: The left pocket panel 250*b*, and the extension strap 246*b* are secured to the anterior side 216*b* of the waist panel 214. The left pocket panel 250*b* and the extension strap 246*b* are secured to the anterior side 216*b* of the waist panel 214.

Overlapping the left pocket panel 250*b*, is a left pocket flap 270*b*, attached to the backside of the flap 270*b*, are the hooks 244, attached to the left pocket panel 250*b*, are the loops 242, which are in alignment with the hooks 244. The waist extension strap 246*b* is secured to left pocket panel 250*b*.

Located on the waist panel's 214 anterior side 216*b* left periphery 222*b* is the permanently attached mating attachment 240*b* hook 244. Located on the left waist-extension strap 246*b* is the mating attachments 240*b* loop 242 and hook 244.

The waist panel 214 and the pocket panel 250*b* are secured together vertically down a right periphery 220*b*, a bottom periphery 226*b* and a left periphery 222*b*. Securing vertically down the center of the waist pocket panel 250*b* a column one

228*b* and a column two 230*b* is made. The result of the securing process is the development of the left waist strap 214*b*.

FIG. 4B gives a detailed posterior view of the lower chamber attachments 212. Illustrated are the right waist strap 214*a* and the left waist strap 214*b*.

First, a posterior side 218*a* of the right waist strap 214*a* is constructed. The construction involves the following process: The right waist pocket panel 250*a*, and the extension strap 246*a* are secured to the waist panel 214. On the backside of waist panel 214, there is the hook 244, which is in alignment with the loop 242 on the top backside of the right pocket panel 250*a*.

Located on the top of the waist pocket panel's 250*a* left periphery 222*a* is the permanently attached mating attachment 240*a* hook 242. Located on the right-extension strap 246*a* is the mating attachments 240*a* loop 242 and hook 244.

The waist panel 214 and the waist pocket panel 250*a* are secured together vertically down the right periphery 220*a*, the bottom periphery 226*a* and the left periphery 222*a*. Securing vertically down the center of the waist pocket panel 250*a* a column one 228*a* and a column two 230*a* is made. The result of the securing process is the development of the posterior side 118*a* of the right waist strap 214*a*.

Next, a posterior side of the 218*b* of the left waist strap 214*b* is constructed. The construction involves the following process: The left pocket panel 250*b*, and the extension strap 246*b* are secured to the waist panel 214. The left pocket panel 250*b* and the extension strap 246*b* are secured to the posterior side 218*a* of the waist panel 214.

On the backside of waist panel 214, there is the hook 244, which is in alignment with the loop 242 on the inside top back of the right pocket panel 250*a*. Securing vertically down the center of the waist panel 214, a row one 232*b* is made into the waist panel 214.

Located on the waist panel's 250*b* right periphery 220*b* is the permanently attached mating attachment 240*b* loop 242. Located on the left waist-extension strap 246*b* is the mating attachments 240*b* loop 242 and hook 244.

The waist panel 214 and the waist pocket panel 250 are secured together vertically down the right periphery 220*b*, the bottom periphery 226*b* and the left periphery 222*b*. Securing vertically down the center of the waist panel 214 a column one 228*b* and a column two 230*b* is made. The result of the securing process is the development of the posterior side 118*b* of the left waist strap 214*b*.

FIGS. 5A, 5B

FIG. 5A is an anterior view of an unconnected layout of the detachable reconfigurable modular pocket assemblage 10 and its components; the chamber 12 and its components; the upper chamber attachments 112 and their components; and the lower chamber attachments 212 and their components.

The posterior side 118*a* of the right shoulder strap 114*a* with the attached extension 146*a* is placed just above the chamber panel one 14*a* column one 28*a*. Located on the posterior side 18*a*, top periphery 24*a* of the chamber panel one 14*a* is the chamber panel one-mating attachment 40*a*, the hook 44, which is in alignment with the right shoulder-mating attachment 140*a* loop 142 located on the top periphery 124*a* of the right shoulder strap 114*a*, posterior side 118*a*.

The posterior side 118*b* of the left shoulder strap 114*b* with the attached extension strap 146*b* is placed just above the chamber panel one 14*a* column two 30*a*. Located on the posterior side 18*a*, top periphery 24*a* of the chamber panel one 14*a* is the chamber panel one-mating attachment 40*a*, the loop 42, which is in alignment with the left shoulder-mating attachment 140*b* hook 144 located on the top periphery 124*b* of the left shoulder strap 114*b*, posterior side 118*b*.

The posterior side 218*a* of the right waist strap 214*a* is placed next to the chamber 12 lower right periphery 20*a*. Located on the posterior side 18*a*, lower right periphery 20*a* of the chamber panel one 14*a* is the chamber panel one-mating attachment 40*a*, the loop 42, which is in alignment with the right waist-mating attachment 240*a* hook 244 located on the left periphery 222*a* of the right waist strap 214*a*, posterior side 218*a*.

The posterior side 218*b* of the left waist strap 214*b* is placed next to the chamber 12 lower left periphery 22*a*. Located on the posterior side 18*a*, lower left periphery 22*a* of the chamber panel one 14*a* is the chamber panel one-mating attachment 40*a*, the hook 44, which is in alignment with the left waist mating attachment 240*b* loop 242 located on the right periphery 220*b* of the left waist strap 214*b*, posterior side 218*b*.

FIG. 5B is a posterior view of a connected layout of the detachable reconfigurable modular pocket assemblage 10 components: The chamber panels 14*a* and 14*b*. The upper chamber attachments 112 shoulder straps 114*a* and 114*b* and the extension straps 146*a* and 146*b*. The lower chamber attachments 212 waist straps 214*a* and 214*b* and the extension straps 246*a* and 246*b*.

Connected to the chamber panel two 14*b* column two 30*b* is the right shoulder strap 114*a*. Located on the top periphery 24*b* of the chamber two panel 14*b* is the chamber panel two-mating attachment 40*b* loop 42. Located on the top periphery 124*a* of the right shoulder strap 114*a* is the right shoulder-mating attachment 140*a* loop 142.

The left shoulder strap 114*b* is connected to the chamber panel two 14*b* column one 28*b*. Located on the top periphery 24*b* of the chamber panel two 14*b* is the chamber panel two-mating attachment 40*b*, the hook 44. Located on the top periphery 124*b* of the left shoulder strap 114*b* is the left shoulder-mating attachment 140*b* hook 144.

The right waist strap 214*a* is connected to the chamber panel two 14*b* column two 30*b*, lower right periphery 20*b*. Located on the lower right periphery 20*b* of the chamber panel two 14*b* is the chamber panel two-mating attachment 40*b*, the hook 44. Located on the right periphery 220*a* of the right waist strap 214*a* is the right waist-mating attachment 240*a* hook 244.

The left waist strap 214*b* is connected to the chamber panel two 14*b* column one 28*b*, lower left periphery 22*b*. Located on the lower left periphery 22*b* of the chamber panel two 14*b* is the chamber panel two-mating attachment 40*b*, the loop 42. Located on the left periphery 222*b* of the left waist strap 214*b* is the left waist-mating attachment 240*b* loop 242.

Next, the chamber panel one 14*a* is turned upside down with bottom periphery 26*a* aligned with the bottom periphery 26*b* of the chamber panel two 14*b*. The chamber panel one 14*a* is folded over chamber panel two 14*b* for the purpose of connecting the mating attachments 40*a*, loops 42 and hooks 44 with the mating attachments 40*b*, 140*b* and 240*b* loops 42 and hooks 44. See FIG. 1A for the complete assemblage of the detachable reconfigurable modular pocket assemblage 10.

Operation

FIGS. 6A, 6B, 6C, 6D, 6F, 6G, 6H, 6I, 6J, 6K, 6L, 6M

Prior to using the detachable reconfigurable modular pocket assemblage 10 as shown in FIG. 1A as a therapeutic device, the user inserts hot or cold packets into the pockets where heat or ice is needed on the body, for use as rehabilitative device, weights are put into the pockets where toning or strengthening is needed for the body. For general-purpose use, an endless list of items can be put in the various pockets at anytime. To accommodate the varying sizes of the users a plurality of additional straps 300 are necessary. The additional straps 300 have a mating attachment 340 (not shown) with at least one loop 342 and at least one hook 344 attached to opposite ends of the additional straps 300. The following FIGS. 6A-6M are some of the many configurations of the detachable reconfigurable modular pocket assemblage 10.

To use the fully assembled pocket assemblage 10 as a backpack, first the chamber 12 is lifted over the head onto the back, leaving the shoulder straps 114*a* and 114*b* hanging on the chest. Second, the shoulder straps 114*a* and 114*b* are crisscrossed on the chest, and the extension strap 146*a* and 146*b* are taken around the body and tied in the back. Third, the waist extension straps 246*a* and 246*b* are tied together in front of the body. See FIGS. 6A and 6B. If a snug fit is desired the shoulder straps 114*a* and 114*b* can be taken under the armpits, crisscrossed in the back, and the extensions straps 146*a* and 146*b* are brought to the front of the body and tied together. See FIG. 6C.

To use the pocket assemblage 10 as a chest pack, first the chamber 12 is placed on the chest leaving the shoulder straps 114*a* and 114*b* on the back. Second, the shoulder straps 114*a* and 114*b* are crisscrossed in the back of the body, and the extension strap 146*a* and 146*b* are taken around the body and tied in the front. Third, once on the chest, the waist extension straps 246*a* and 246*b* (not shown) are tied together behind the body. See FIG. 6D.

To use the fully assembled pocket assemblage 10 as a thigh wrap, it may be necessary to use the additional straps 300. First, the mating attachment 340, loop 342 or hook 344 on the additional straps 300 is attached to the mating attachment 140, loop 142 or hook 144 on the shoulder extension straps 146*a* and 146*b* (FIG. 5A). Second, the pocket assemblage 10 is placed on the chest, and lowered down to the thigh. Third, the additional straps 300 are crisscrossed in the back of the body, and taken around the body and tied in the front. Fourth, the waist extension straps 246*a* and 246*b* are wrapped around the chamber 12 and tied together. See FIG. 6E.

To use the fully assembled pocket assemblage 10 as a hamstring wrap, it may be necessary to use the additional straps 300. First, the mating attachment 340, loop 342 or hook 344 shown in FIG. 6E on the additional straps 300 is attached to the mating attachment 140, loop 142 or hook 144 on the shoulder extension straps 146*a* and 146*b* (FIG. 5A). Second, the chamber 12 is lifted over the head onto the back, and lowered down to the hamstring. Third, the additional straps 300 are crisscrossed in the front of the body, and taken around the body and tied together in the back of the body. Fourth, the waist extension straps 246*a* and 246*b* are wrapped around the chamber 12 and tied together. See FIG. 6F.

In operation as a single panel backpack, single panel chest pack, arm slang, various chambers, various wraps, fanny packs, hands bags, and shoulder bags, etc, the assemblage 10 must be detached and reconfigured in combination with the other parts.

An example of combining parts is a back pack-chest pack combination. First, the waist mating attachments 240*a* the loop 242 and hook 244 on the right waist strap 214*a* and left waist strap 214*b* are connected to the chamber mating attachments 40*b* on the chamber panel two 14*b* top periphery 24*b*. Second, the chamber panel two 14*b* is placed on the chest and, the extension straps 246*a* and 246*b* are wrapped around the neck, and tied together in the front. Third, the shoulder mating attachments 140*a* loop 142 and hook 144 on the right shoulder strap 114*a* and left shoulder strap 114*b* are connected to the chamber mating attachments 40*a* on the chamber panel one 14*a* top periphery 24*a*. Fourth, the chamber panel one 14*a* thrown over the shoulders, the shoulder strap 114*a* is taken under the right armpit and the shoulder strap 114*b* brought under the armpit the left armpit. The extension straps 246*a* and 246*b* are crossed in the back, wrapped around the waist and tied in the front. No FIGS. shown.

Another example of a combination with the other parts would be using only one panel 14*a* and attaching the shoulder straps 114*a* and 114*b* to the top periphery 24*a* of panel 14*a*, and the waist straps 214*a* and 214*b* to the lower peripheries 20*a* and 22*a*, we have now configured a single panel backpack or chest pack. No FIGS. shown.

In use as an arm slang is another example of parts (either (a) for right or (b) for left can be used (a) will be used here), being combined. First, the shoulder mating attachment 140*a* hook 144 on the right shoulder strap 114*a* (FIGS. 3A, 3B) is attached to the chamber mating attachment 40*a* loop 44 on the top periphery 14*a* of chamber panel one 14*a*. (FIG. 2G) Second, the shoulder mating attachment 140*a* loop 142 on the right shoulder extension strap 146*a* is attached to the hook 44 on top periphery 14*a* of chamber panel one 14*a*. Third, the chamber panel one 14*a* is folded in half horizontally and the mating attachments 40*a* hook 44 and loop 42 on the bottom periphery 26*a* are aligned and connected to the top periphery 24*a*. Fourth, the connected straps 114*a* and 146*a* are brought over the head and around the neck, and the arm is inserted into the slang. See FIG. 6G.

Another result of combining parts is a therapeutic shoulder wrap. First, chamber mating attachments 40*a* and 40*b* on the chamber panels 14*a* and 14*b* are connected together along the top peripheries 24*a* and 24*b* (FIGS. 2G, 2H). Second, the panels are draped over the shoulder and the right peripheries 20*a* and 20*b* are connected under the armpits. See FIG. 6H.

Figure 6A:
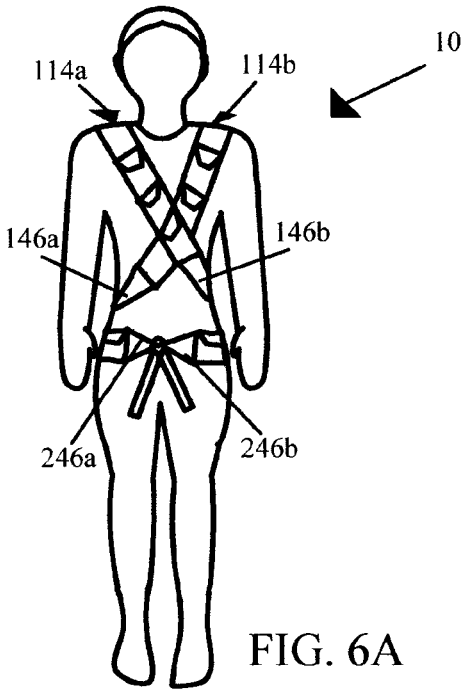
Figure 6B:
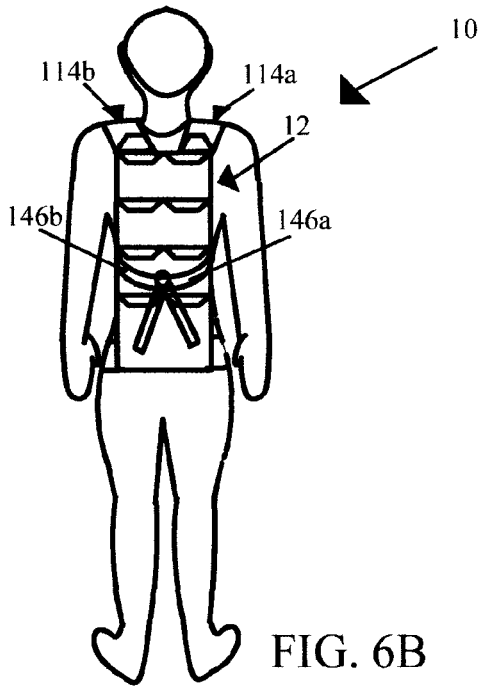
Figure 6C:
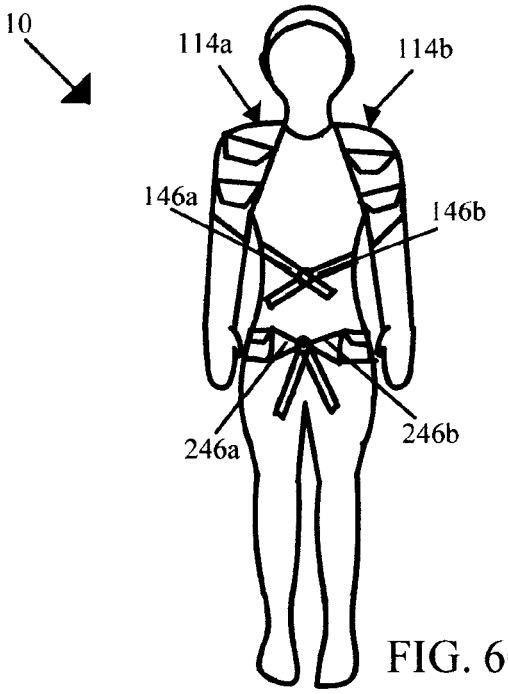
Figure 6D:
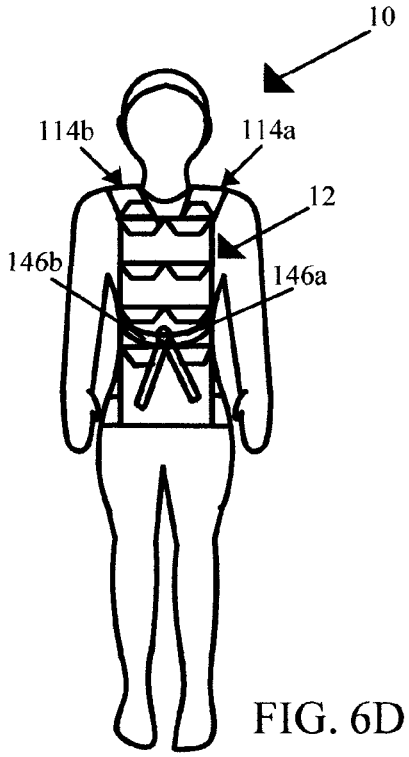
Figure 6E:
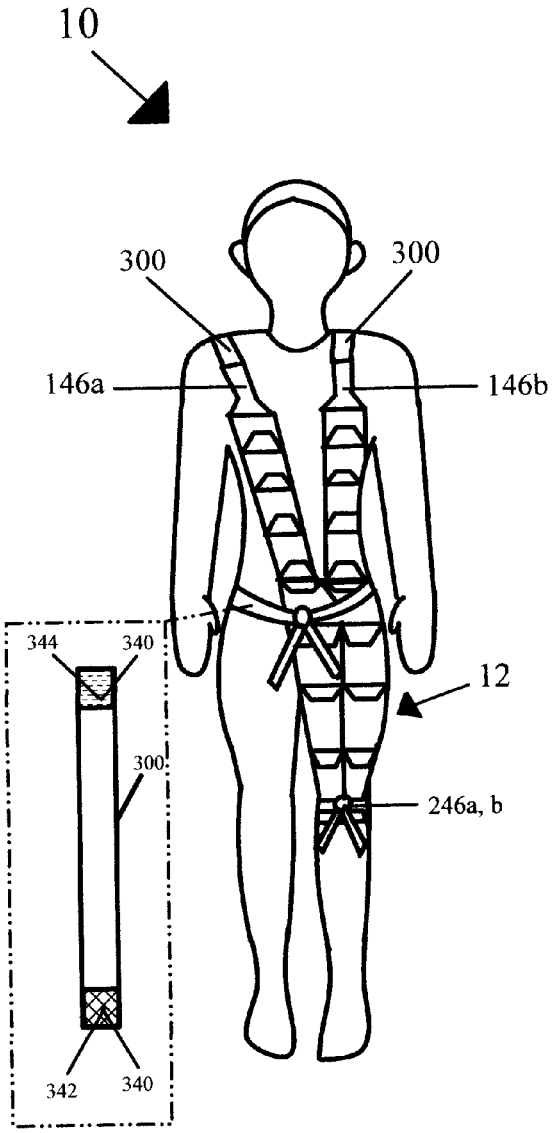
Figure 6F:
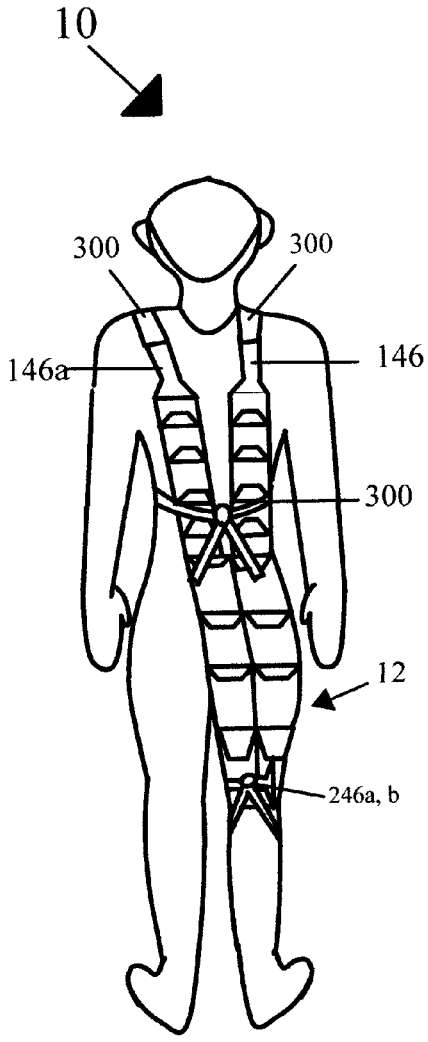
Figure 6G:
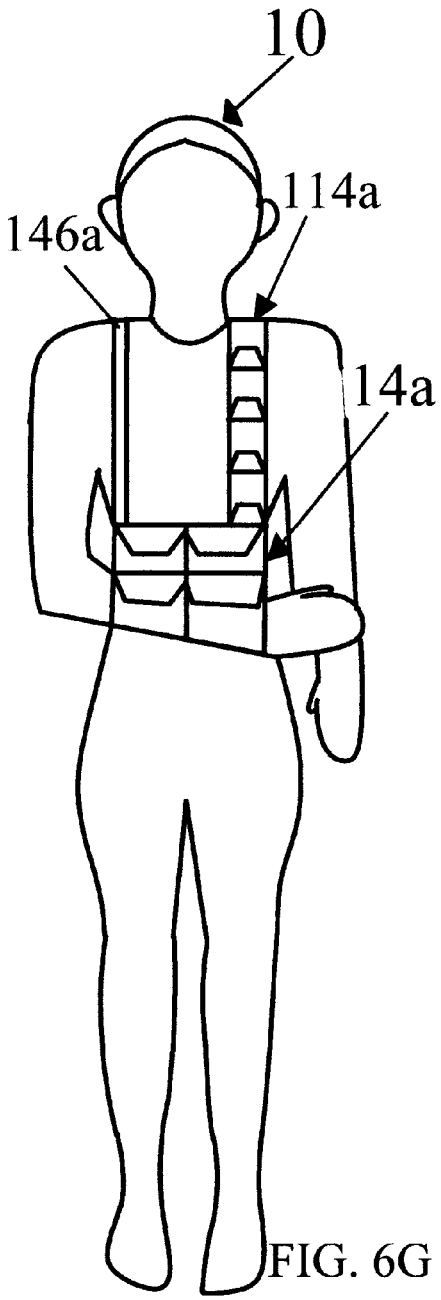
Figure 6H:
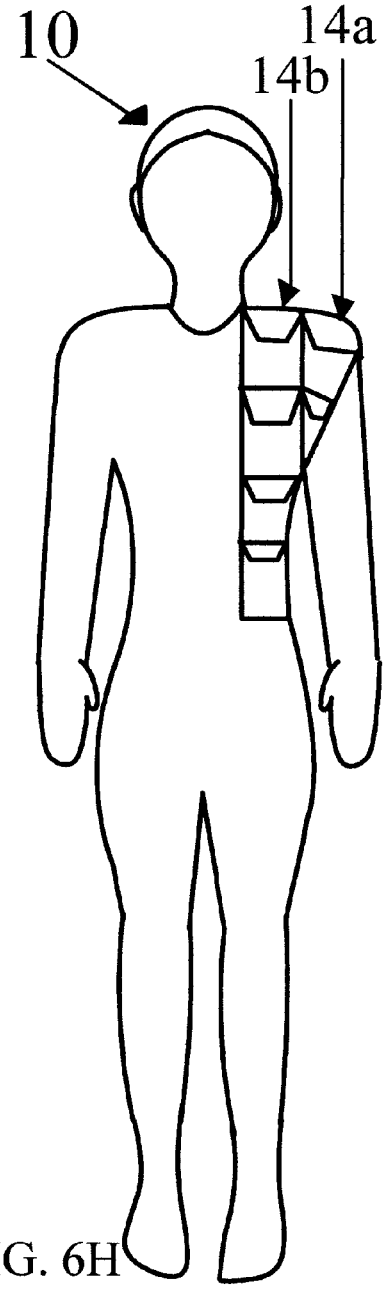
Figure 6I:
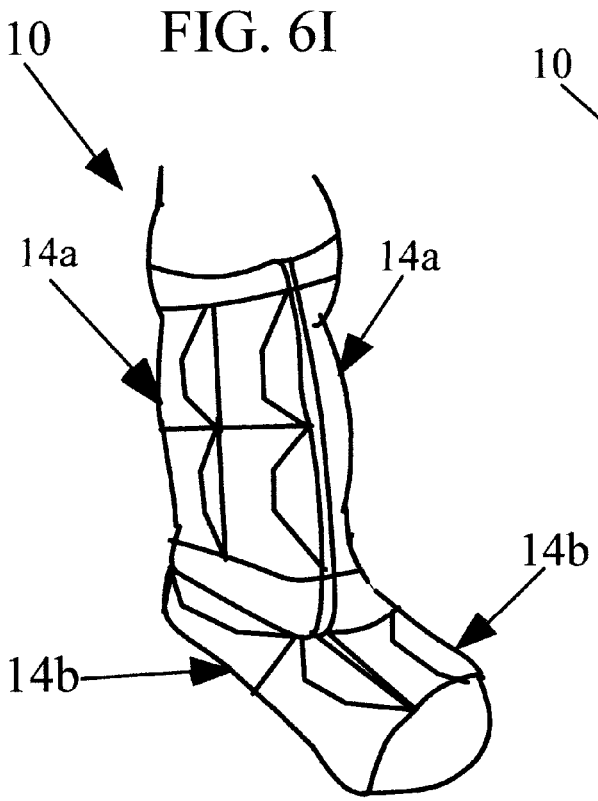
Figure 6J:
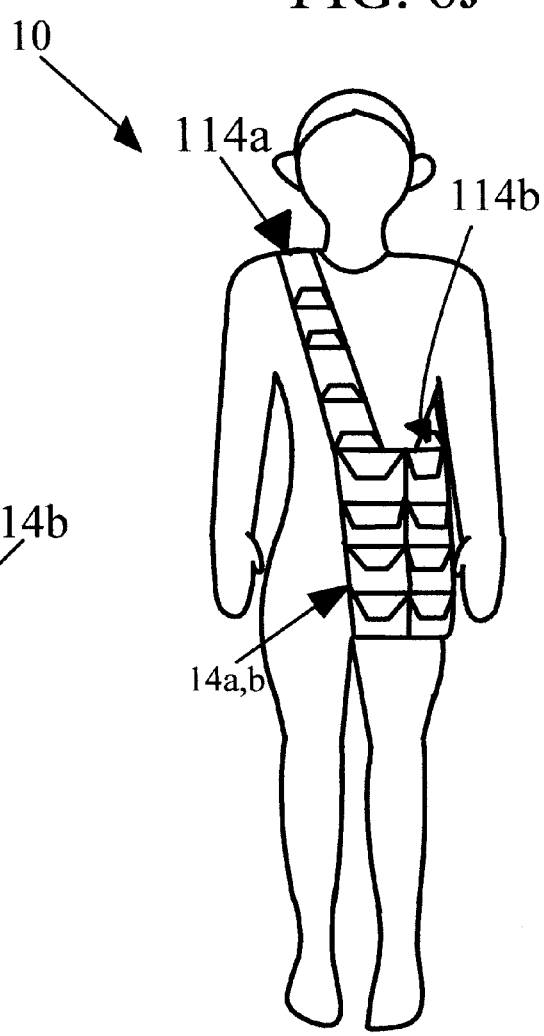
Figure 6K:
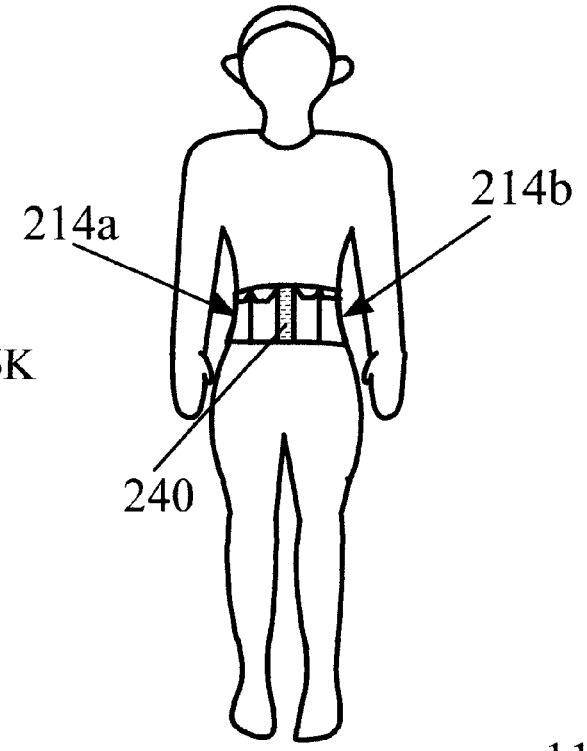
Figure 6L:
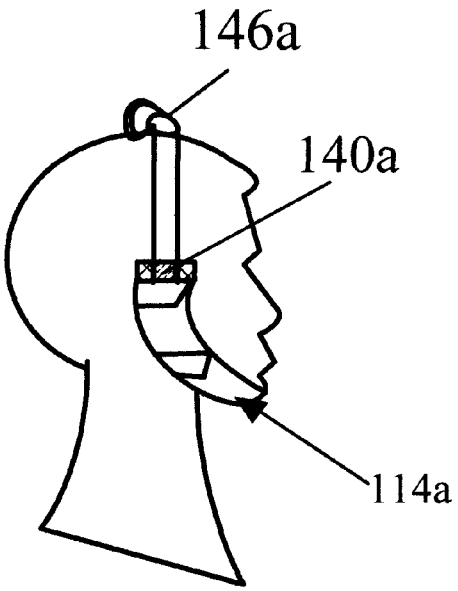
Figure 6M:
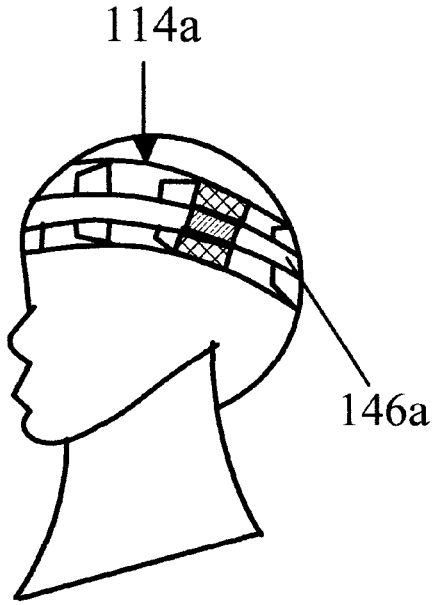

Using the chamber panel one 14*a* and chamber panel two 14*b* (FIGS. 2G, 2H) a boot can be configured for therapeutic or rehabilitative use. First, the chamber panel one 14*a* is turned side ways and wrapped around the lower leg by connection the mating attachments 40*a* located on the top periphery 24*a* and the bottom periphery 26*a*. Second, the chamber panel two 14*b* is placed horizontally on the floor and the user's foot is placed on top of the chamber panel two 14*b*. Third, the mating attachments 40*b* located on the chamber panel two's peripheries 20*b*, 24*b* and 26*b* are connected in the front of the user's leg. Fourth, the chamber panel two's peripheries 22*b*, 24*b* and 26*b* are connected in the back of the user's leg. See. FIG. 6I.

In use as a general purpose shoulder bag first, the mating attachments 140*a* located on the top peripheries 124*a* and 124*b* of the shoulder straps 114*a* and 114*b* (FIGS. 3A, 3*b*) are placed between chamber panels 14*a* and 14*b* (FIG. 2H) and connected to the mating attachments 40*a* located on the top peripheries 24*a* and 24*b*. Second, the shoulder extension straps 146*a* and 146*b* are tied together. Third, the connected straps 114*a* and 146*a* are brought over the head and around the neck. See FIG. 6J In use as a general purpose or therapeutic fanny pack, the two waist straps 214*a* and 214*b* (FIGS. 4A, 4B) must be used together. First, the mating attachment 240 loop 242 attached to the right periphery 220*b* of the left waist strap 214*b* is folded back, and placed on top of the mating attachment 240*a* hook 244 on the left periphery 222*a* of the right waist strap 214*a*. The extension straps 246*a* and 246*b* are brought around the waist and tied in the back of the body. See FIG. 6K.

Singular use of the detachable parts would be the shoulder straps 114*a* or 114*b* (FIGS. 3A, 3B) being used for wraps. In use as a chin or face wrap for therapeutic or rehabilitative use (either (a) for right or (b) for left can be used (a) will be used here), the shoulder strap 114*a* is placed under the chin and secured on the top of the head, by connecting the mating attachment 140 located on the extension strap 146 to the mating attachment 140 located on the shoulder strap 114*a* and tying the extension strap 146*a* to its self. See FIG. 6L. In use as a forehead wrap for therapeutic or rehabilitative use, (either (a) for right or (b) for left can be used (a) will be used here), the shoulder strap 114*a* is placed on the forehead and wrapped around the head to be secured on the back of the head, by tying the extension strap 146*a* to its self. See FIG. 6M.

Some other uses of the shoulder straps 114*a* or 114*b*, which are made possible by wrapping the straps 114*a* or 114*b* around the waist, toes, head, neck, knees, and the ankle, by tying the extension strap 146*a* or 146*b* to its self. No FIGS. shown.

The chamber panels 14*a* or 14*b* are configured for use as an upper arm wrap, lower arm wrap, lower leg wrap, upper leg wrap, and a hand and wrist chamber, by folding the chamber panels 14*a* or 14*b* vertically or horizontally, and connecting the mating attachment 40 loop 42 and the hook 44 located along the peripheries together. No FIGS shown.

Other Embodiments FIGS. 7A, 7B, 7C, 7D, 7E, 7F, 7G

Other embodiments of the pocket assemblage 10 may be further described with reference to FIGS. 7A, 7B, 7C, 7D, 7E, 7F, 7G. These embodiments are similar to FIG. 1A with the main differences being: There are fewer configuration capabilities. There are no pocket flaps, 70, 170 and 270. With the exception of FIG. 7C there are no pocket panels, 50, 150 and 250. The location of a plurality of chamber pocket openings 82, a plurality of shoulder pocket openings 182, and a plurality of waist pocket openings 282 has different placements. In addition, the length of the shoulder extension straps 146 and the waist extension straps 246 are longer. These embodiment can be used on other parts of the body, however, only the use as a backpack or chest pack will be explained.

Figure 7A:
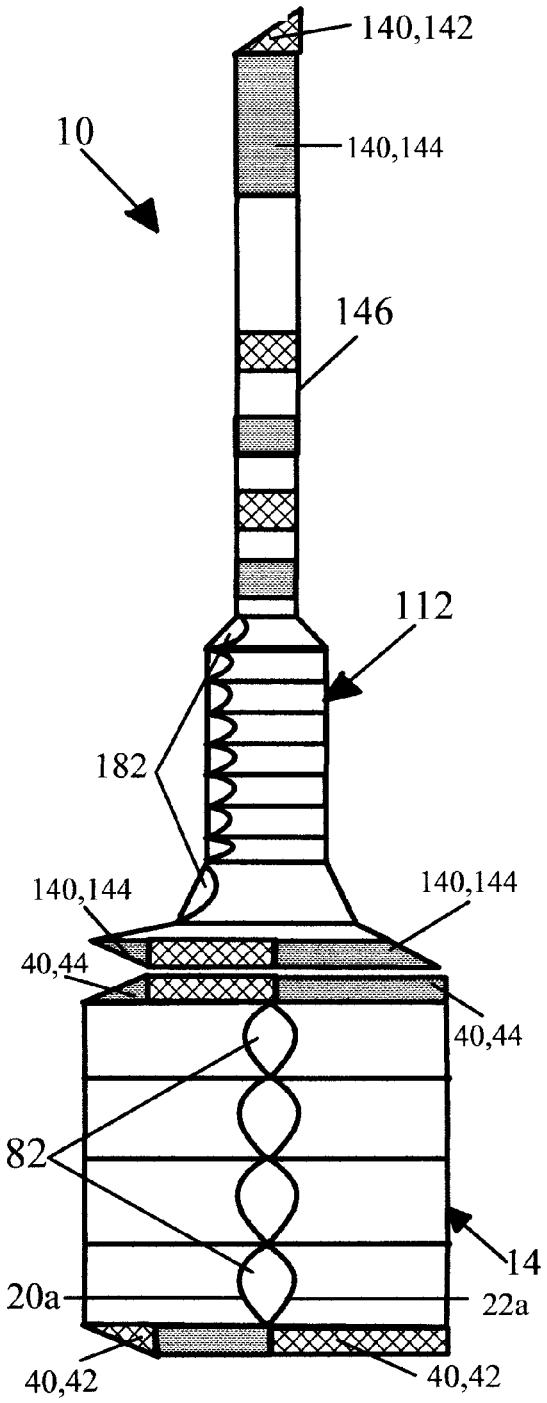

FIG. 7A anterior view. This embodiment has one chamber panel 14, which is used as the chamber 12, and one upper chamber attachment 112. The upper chamber attachment 112 is a single unit comprising; the extension strap 146 with strategically placed, loop(s) 142 and hook (s) 144.

The chamber panel's 14 right periphery 20*a* and left periphery 22*a* are vertically folded to the center, with the right periphery 20*a* overlapping the left periphery 22*a* and secured horizontally leaving the plurality of chamber pocket openings 82. Securing horizontally across the upper chamber attachment 112 pocket openings 182 are made into the upper chamber attachment 112.

In operation the mating attachment 140 loops 142 and hooks 144 located on the upper chamber attachment 112 is attached to the mating attachment 140 loops 142 and hooks 144 located on the chamber panel 14. The chamber panel 14 is folded in half horizontally, the assemblage 10 is placed on the body by wrapping the upper chamber attachment 112 around the neck and the torso and connecting the mating attachment 140 loops 142 and hooks 144 on the extension strap 146 together.

Figure 7B:
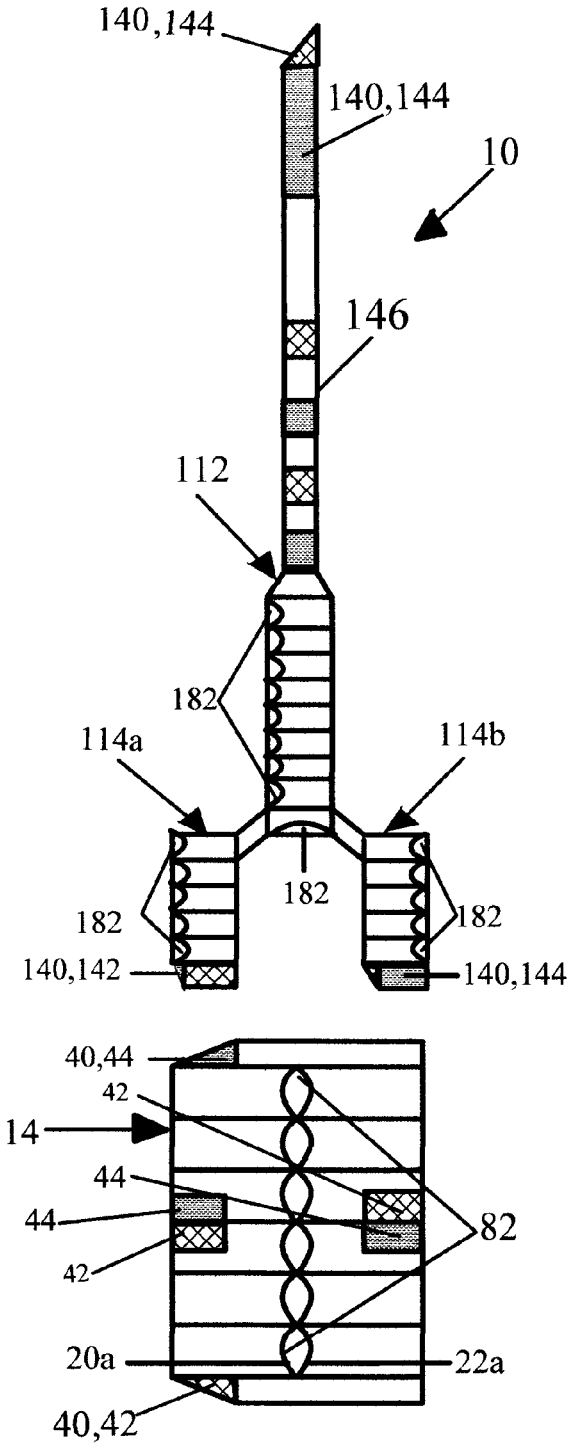

FIG. 7B anterior view. This embodiment has one chamber panel 14, which is used as the chamber 12, and one upper chamber attachment 112. The upper chamber attachment 112 is a single unit comprising; the right shoulder strap 114*a*, the left shoulder strap 114*b* and the extension strap 146.

The chamber panel's 14 right periphery 20*a* and left periphery 22*a* are vertically folded to the center, with the right periphery 20*a* overlapping the left periphery 22*a* and secured horizontally leaving the plurality of chamber pocket openings 82. At the mid point on the chamber panel 14 are loops 42 and hooks 44 for the main purpose of attaching the extension strap 146 to the chamber panel 14.

Securing horizontally across the shoulder straps 114*a* and 114*b* and vertically down predetermined peripheries pocket openings 182 are made into the shoulder straps 114*a* and 114*b*.

Securing horizontally across the shoulder extension strap 146 and vertically down predetermined peripheries, pocket openings 182 are made into the extension strap 146.

In operation, the mating attachments 140*a* and 140*b* hooks 144 and loops 142 on the shoulder straps 114*a* and 114*b* are attached to the mating attachments 40 hooks 44 and loops 42 on the chamber panel 14. The chamber panel 14 is folded in half horizontally, the assemblage 10 is placed on the body, by wrapping the extension strap 146 around the torso, and connecting the mating attachment 140 loop 142 or hook 144 to the chamber mating attachment 40 loop 42 or hook 44.

Figure 7C:
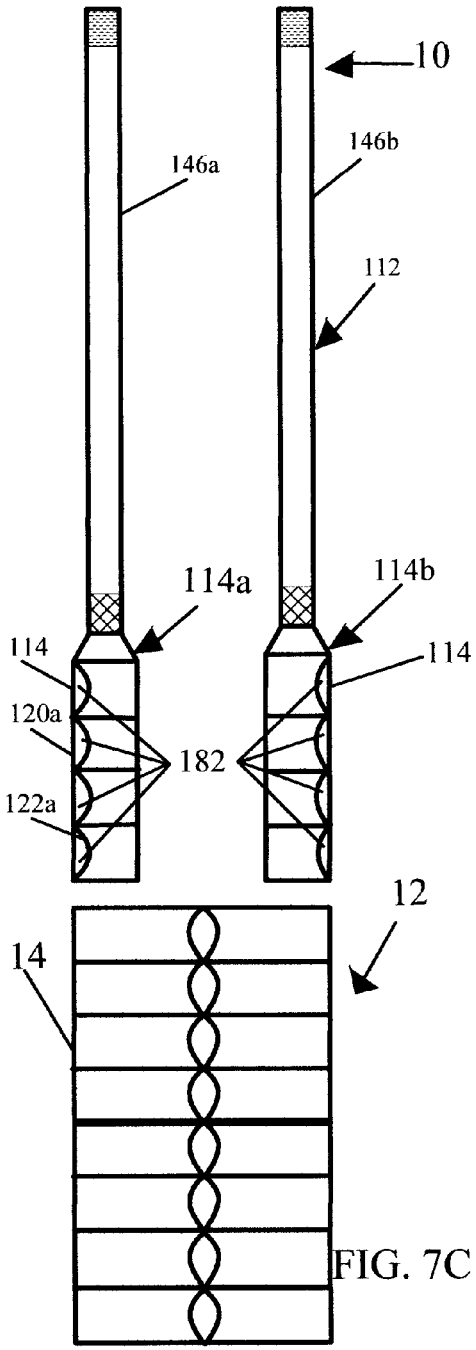

FIG. 7C anterior view. This embodiment has one chamber panel 14, which is used as the chamber 12, and is similar to the one illustrated in FIG. 7B. The upper chamber attachments 112 comprise; the right shoulder strap 114*a* with the attached extension strap 146*a* and the left shoulder strap 114*b* with the attached extension strap 146*b*.

The shoulder panel 114 is folded in half vertically, the right and left peripheries 120*a* and 122*a* are brought together and secured horizontally leaving pocket openings 182 along the right shoulder strap 114*a* right periphery 120*a*, this same process is used to make the left shoulder strap 114*b*.

In operation, shoulder straps 114*a* and 114*b* are attached to the chamber panel 14. The chamber panel 14 is folded in half horizontally, and the assemblage 10 is placed on the body, the extra long shoulder extension straps 146*a* and 146*b* are wrapped around the torso and tied together.

Figure 7D:
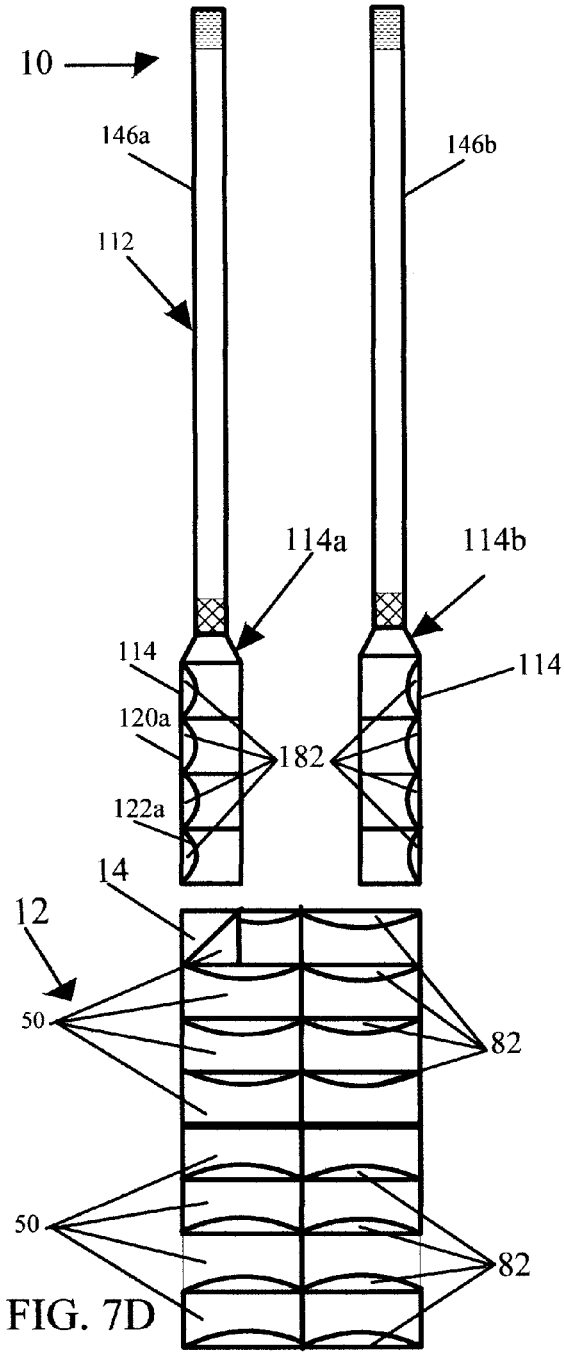

FIG. 7D anterior view. Except for the chamber 14 this embodiment is identical to FIG. 7C. In this embodiment there are several chamber pocket panels 50 secured to the chamber panel 14. Half of the chamber pocket panels 50 are secured to the chamber panel 14 with the chamber pocket openings 82 positioned upward. The other half of the chamber pocket panels 50 are secured to the chamber panel 14 with the pocket openings 82 positioned downward. When the chamber panel 14 is folded under at the mid point all pocket openings 82 will be in an upward position.

In operation, this embodiment operates in the same manner as the pocket assemblage illustrated in FIG. 7C.

Figure 7E:
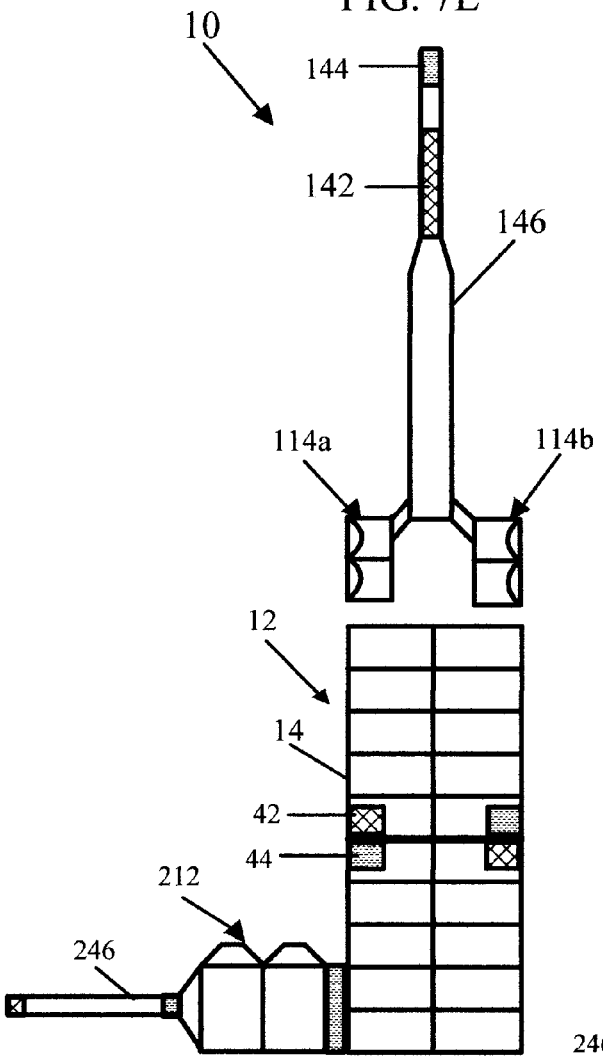

FIG. 7E anterior view. This embodiment is similar to FIG. 7B, the differences being, the shoulder extension strap 146 does not have pocket openings and there is one lower chamber attachment 212.

In operation, the lower chamber attachment 212, the shoulder straps 114*a* and 114*b* are attached to the chamber panel 14. The chamber panel 14 is folded in half horizontally, and the assemblage 10 is placed on the body. Once on the body the 140 hook 144 and loop 142 on the shoulder extension strap 146 are connected to form an noose. Next, the waist extension strap 246 is pulled thru the noose, wrapped around the torso and the loops 242 and hooks 244 on the extension strap are connected to the loops 42 and hooks 44 located on the chamber panel 14.

Figure 7F:
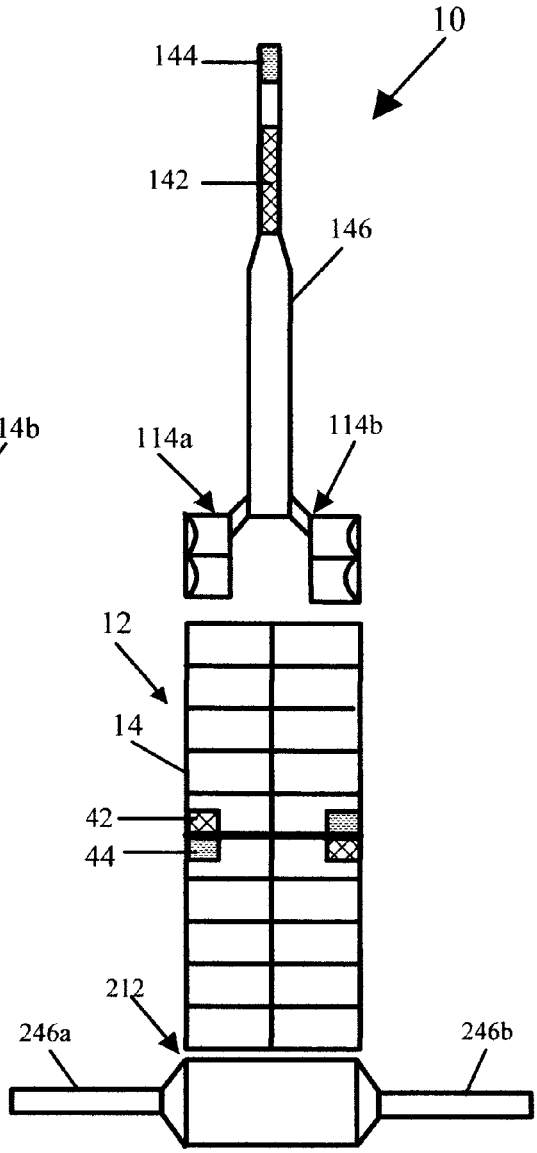

FIG. 7F anterior view. This embodiment is similar to FIG. 7E. With the difference, being there is one lower chamber attachment 212, with one waist strap 214 and two extension straps 246*a* and 246*b*.

In operation, the lower chamber attachment 212, the shoulder straps 114*a* and 114*b* are attached to the chamber panel 14. The chamber panel 14 is folded in half horizontally, and the assemblage 10 is placed on the body. Once on the body the mating attachment 140 hook 144 and loop 142 on the shoulder extension strap 146 are connected to form an noose. Next, the waist extension straps 246 are pulled thru the noose and tied together.

Figure 7G:
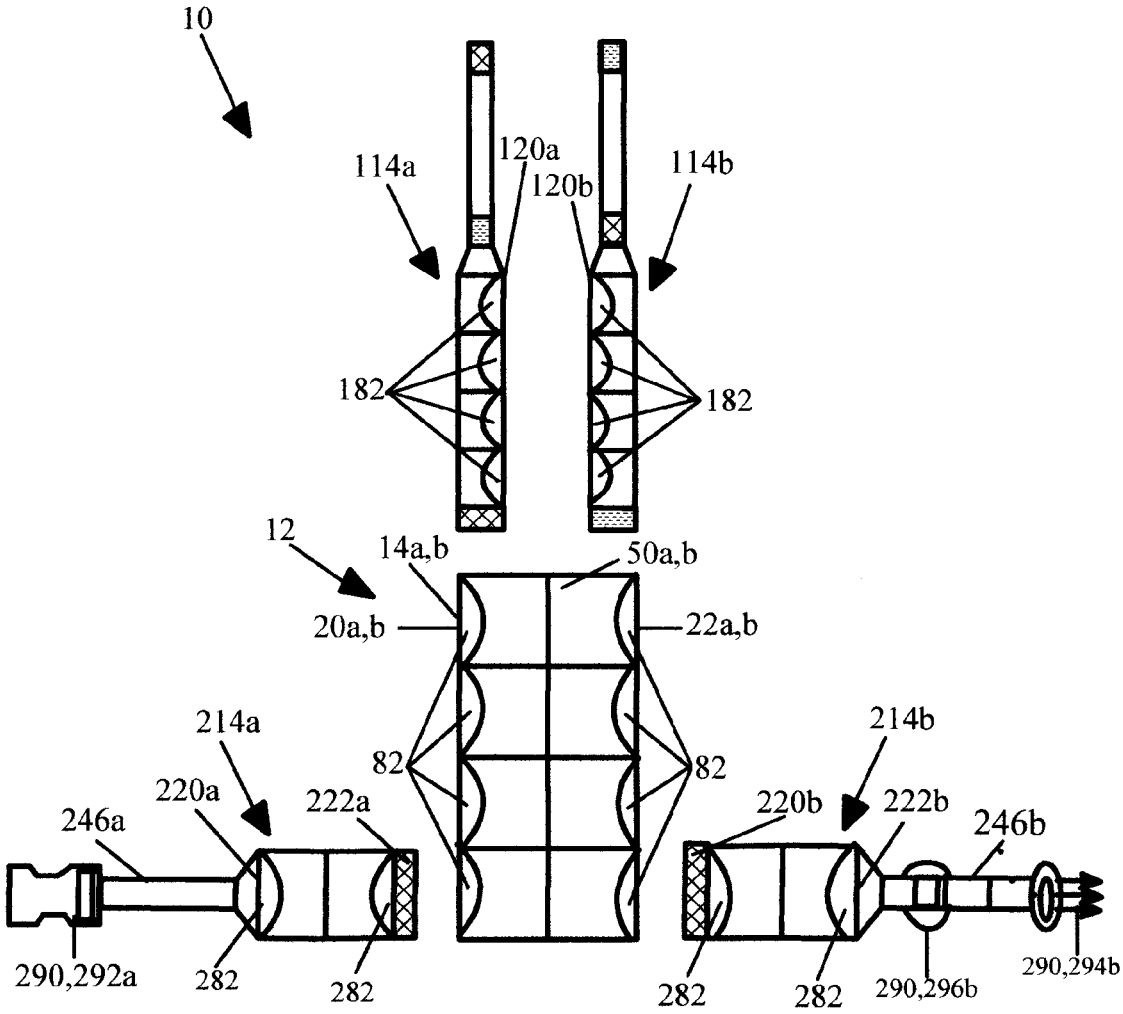

FIG. 7G in this embodiment there is one large pocket panel 50 secured to the chamber panel one 14*a* and the chamber panel two 14*b*. Pocket openings 82 are located on the right periphery 20*a*, and 20*b* and left periphery 22*a* and 22*b*.

The right shoulder strap 114*a* has pocket openings 182 on the right periphery 120*a*. The left shoulder strap 114*b* has pocket openings 182 on the left periphery 120*b*.

The right waist strap 214*a* has pocket openings 282 facing the right periphery 220*a* and the left periphery 222*a*. The left waist strap 214*b* has pocket openings 282 facing the right periphery 220*b* and the left periphery 222*b*. Attached to the extension straps 246*a* and 246*b* is a waist strap fastener combination 290. Comprising a right buckle 292*a*, a buckle release 294*b* and a buckle slide 296*b* attached to the extension straps 246*a* and 246*b*

In operation, this embodiment operates in a manner similar to the pocket assemblage shown in FIG. 1A. The difference being the waist extension strap 246*a* and 246*b* are buckled together instead of tied.

Another embodiment of the pocket assemblage 10 is further described. In this embodiment, the chamber panel one 14*a* and chamber panel two 14*b* have mating attachments 40 hooks 44 and loops 42 on both the anterior side 16*a* peripheries 20*a*, 22*a*, 24*a*, and 26*a*, and the posterior side 18*b* peripheries 20*b*, 22*b*, 24*b*, and 26*b*. In operation, this embodiment operates in the same manner as the pocket assemblage 10 shown in FIG. 1A. No FIG. shown.

Another embodiment of the pocket assemblage 10 is further described. This embodiment is similar to FIG. 1A with the difference being there are several pocket panels 54*a*, 54*b*, 56*a*, 56*b* 58*a*, 58*b*, and 60*a* 60*b* stacked on top of each other with the result being the chamber 12 has compartments within the pockets. There are several pocket panels 154*a*, 154*b*, 156*a*, 156*b*, 158*a*, 158*b*, and 160*a* 160*b* stacked on top of each other with the result being the shoulder straps 114*a* and 114*b* has compartments within the pockets. There are several pocket panels 250*a* and 250*b*, stacked on top of each other with the result being the waist straps 214*a* and 214*b* has compartments within the pockets. In operation, this embodiment operates in the same manner as the pocket assemblage 10 illustrated in FIG. 1A. No FIG. shown.

Another embodiment of the pocket assemblage 10 is further described. This embodiment is similar to FIG. 1A with the difference being the pocket panels Ma, 54*b*, 56*a*, 56*b* 58*a*, 58*b*, 60*a* and 60*b* on the chamber panel one 14*a* and the chamber panel two 14*b* are detachable. The pocket panels 154*a*, 154*b*, 156*a*, 156*b*, 158*a*, 158*b*, 160*a*, and 160*b* on the shoulder straps 114*a* and 114*b* pockets are detachable, as well as the pocket panels 250*a* and 250*b* on the waist straps 214*a* and 214*b*. Additionally, the shoulder extension straps 146*a*, 146*b* and the waist extension 246*a* and 246*b* could be detachable. In operation, this embodiment operates in the same manner as the pocket assemblage 10 illustrated in FIG. 1A. No FIG. shown.

Another embodiment of the pocket assemblage 10 is further described. This embodiment is similar to FIG. 1A with the difference being all pockets have therapeutic packets or rehabilitating weights inserted in the pockets and permanently sealed. In operation, this embodiment operates in the same manner as the pocket assemblage 10 illustrated in FIG. 1A. No FIG. shown.

Another embodiment of the pocket assemblage 10 is further described. This embodiment is similar to the embodiment illustrated in FIG. 1A with the difference being the waist pockets 250*a* and 250*b* has the top periphery 224*a* and the top periphery 224*b* and the bottom periphery 226*a* and 226*b* with hook 244 and loop material 242. On the inside front of the right pocket panel 250*a*, and the left pocket panel 250*b*, are loops 242. On the inside back of the right pocket panel 250*a*, and the left pocket panel 250*b*, are hooks 244. On the inside front of the right pocket panel 250*a*, and the left pocket panel 250*b*, are loops 242. On the inside back of the right pocket panel 250*a*, and the left pocket panel 250*b*, are hooks 244. In operation, this embodiment operates in the same manner as the pocket assemblage 10. No FIG. shown.

Anterior Views of Other Embodiments with Different Shapes. FIGS. 8A, 8B, 8C, 8D, 8E Other embodiments of the pocket assemblage 10 may be further described with reference to FIGS. 8A, 8B, 8C, 8D, 8E. These embodiments are similar to the embodiment shown in FIG. 1A with the exception being the shapes of the chamber panels 14 and there are no pocket flaps on the pocket assemblage 10. In operation, these embodiments operates in the same manner as the pocket assemblage 10 shown in FIG. 1A.

Figure 8A:
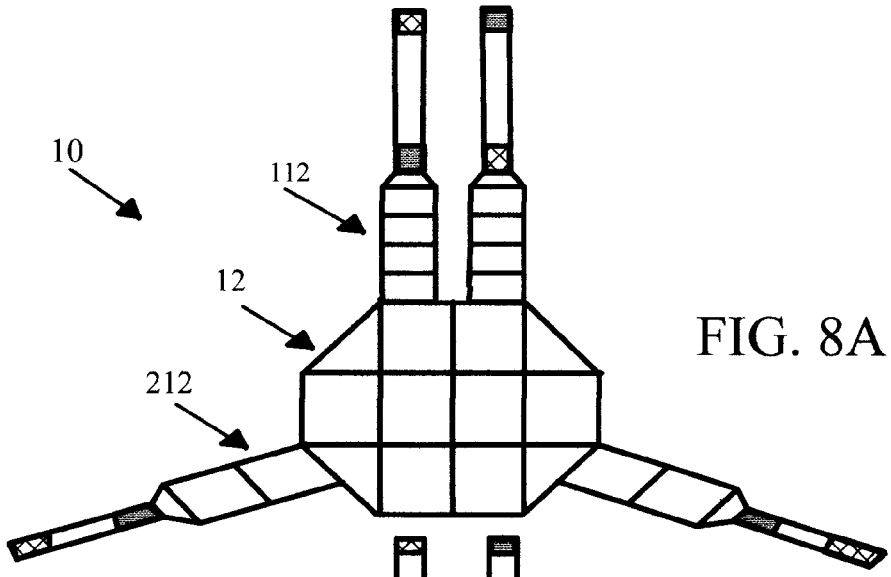

FIG. 8A, this embodiment is similar to the assemblage 10 shown in FIG. 1A with the main exception being the octagon shape of the chamber panels 14 with pockets. The main components are the detachable chamber 12, is the upper chamber attachments 112 and the lower chamber attachments 212.

Figure 8B:
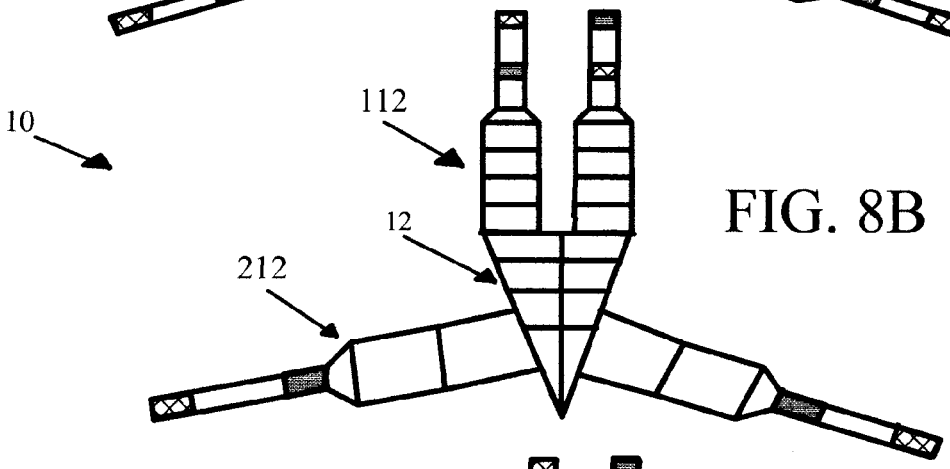

FIG. 8B, this embodiment is similar to the assemblage 10 shown in FIG. 1A with the main exception being the triangular shape of the chamber panels 14 with pockets. The main components are the detachable chamber 12, is the upper chamber attachments 112 and the lower chamber attachments 212.

Figure 8C:
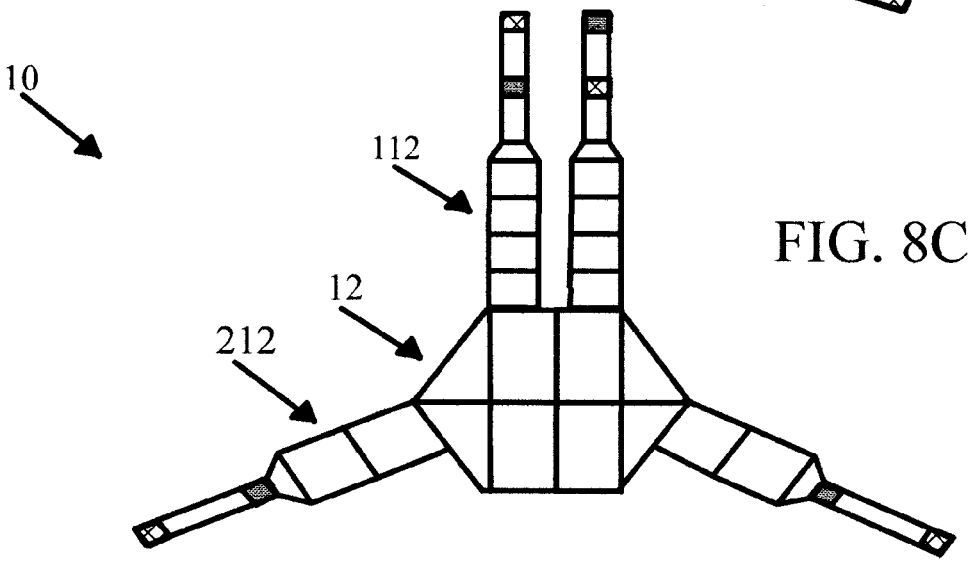

FIG. 8C, this embodiment is similar to the assemblage 10 shown in FIG. 1A with the main exception being the hexagon shape of the chamber panels 14 with pockets. The main components are the detachable chamber 12, is the upper chamber attachments 112 and the lower chamber attachments 212.

Figure 8D:
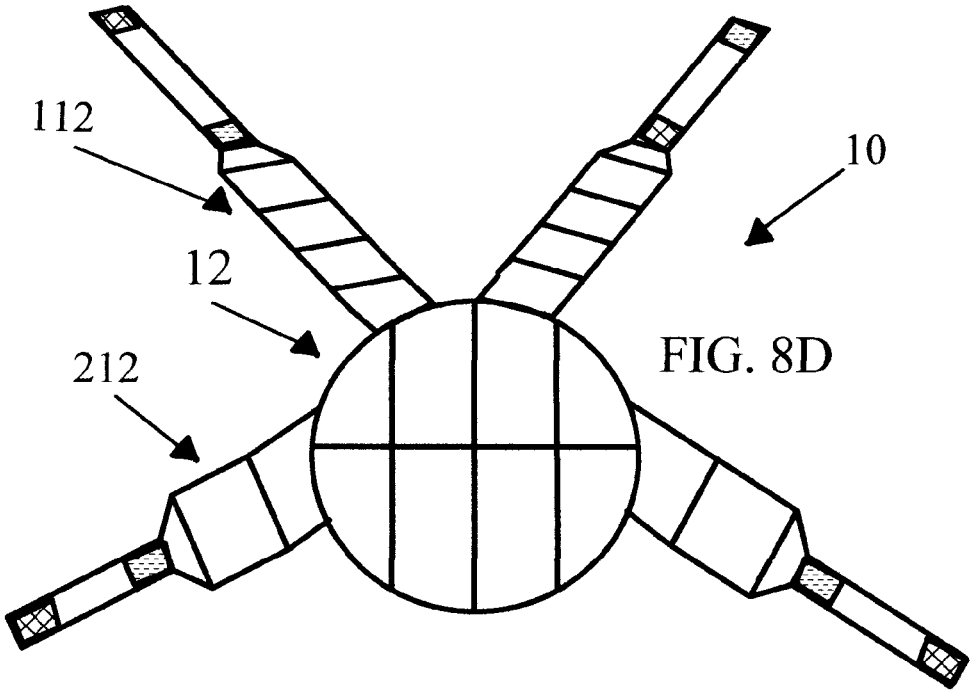

FIG. 8D, this embodiment is similar to the assemblage 10 shown in FIG. 1A with the main exception being the circular shape of the chamber panels 14 with pockets. The main components are the detachable chamber 12, is the upper chamber attachments 112 and the lower chamber attachments 212.

Figure 8E:
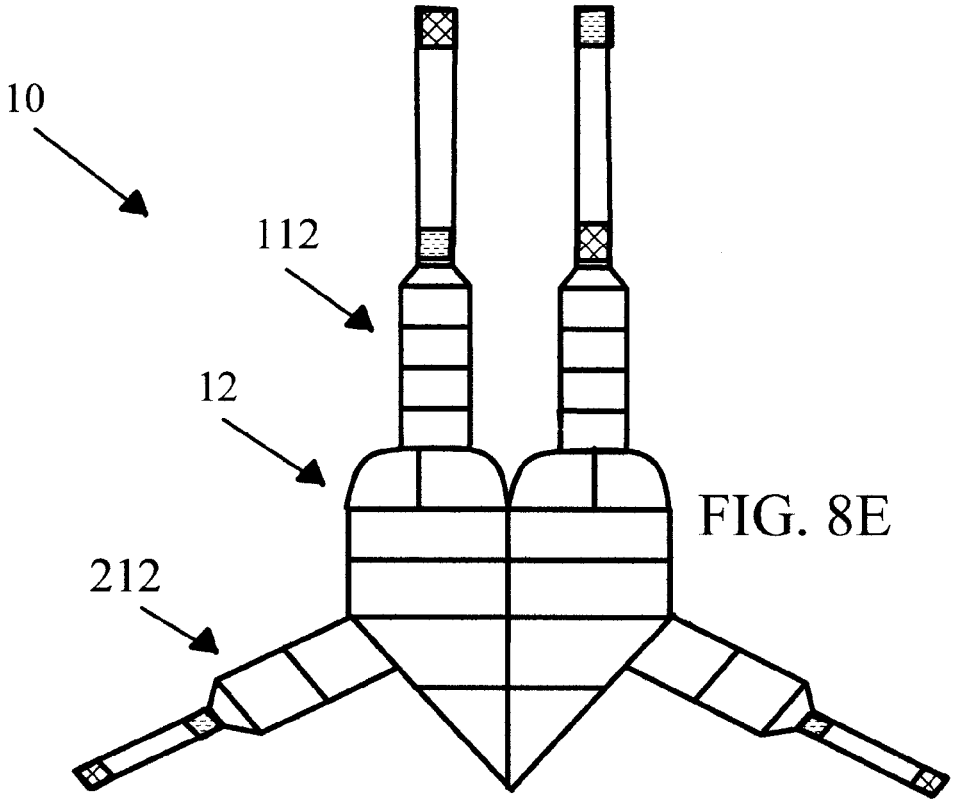

FIG. 8E, this embodiment is similar to the assemblage 10 shown in FIG. 1A with the main exception being the heart shape of the chamber panels 14 with pockets. The main components are the detachable chamber 12, is the upper chamber attachments 112 and the lower chamber attachments 212.

CONCLUSION, RAMIFICATIONS, AND SCOPE

I have shown the pocket assemblage shown in FIG. 1A as having three main parts: a detachable chamber with pockets, upper body attachment with pockets, and a lower body attachment with pockets.

The chamber has a panel one, and a panel two made of flexible material, each panel has hooks, and loops permanently attached along the posterior peripheries, for connecting the peripheries of the panels to form a detachable and reconfigurable chamber.

The upper body attachment and lower body attachment are also made of a flexible material. The upper body attachment has shoulder straps with extension straps attached to the ends, the lower body attachment has waist straps with extension straps attached the ends. The shoulder straps have hooks and loops along the top peripheries, and the waist straps have loops and hooks along their lateral peripheries that connect to the chamber panels for forming the detachable reconfigurable modular pocket assemblage.

Due to its design, the strategic placement of mating attachments; hooks and loops, and the materials used, the pocket assemblage is not only different from prior art; it also overcomes the limitations of prior art by being a single assemblage that is multifunctional and affordable. The therapeutic ice and heat packs, as well as rehabilitating weight insertions, can be made by the user, or purchased inexpensively at the store, and used on all parts of the body.

Although various embodiments of the detachable reconfigurable modular pocket assemblage has been illustrated and described, the pocket assemblage is not limited to the embodiments disclosed but is capable of numerous rearrangements, modifications and substitutions.

Modifications and alterations in the form and arrangement of parts will suggest themselves to those skilled in the art and it is to be understood that such different forms of construction are contemplated as forming a part of this present disclosure as far as they fall within the scope of the following claims.

Thus the scope of the present disclosure should be determined by the appended claims and their legal equivalents, rather than by the examples given.

I claim:

1. A method of arranging releasable mating attachments of flexible materials for making detachable multi-functional, reconfigurable modular assemblage of pockets, comprising the steps:

(a) cutting a flexible material into geometric shapes for the purpose of making at least one chamber panel, at least one shoulder panel, and at least one waist panel;

(b) cutting a flexible material into geometric shapes for making at least one chamber pocket panel, at least one shoulder pocket panel, and at least one waist pocket panel;

(c) cutting a flexible material into geometric shapes for making at least one chamber pocket flap, at least one shoulder pocket flap, and at least one waist pocket flap;

(d) cutting a flexible material into geometric shapes for making at least one right shoulder extension strap and at least one left shoulder extension strap;

(e) cutting a flexible material into geometric shapes for making at least one right waist extension strap and at least one left waist extension strap;

(f) attaching a hook material onto a backside of said chamber pocket flaps, said shoulder pocket flaps, and said waist pocket flaps;

(g) attaching a loop material to a front of said chamber pocket panels, said shoulder pocket panels, and said waist pocket panels, for the purpose of fastening and unfastening pocket openings;

(h) attaching said chamber pocket flaps to a chamber panel top periphery, (i) attaching said shoulder pocket flaps to a shoulder panel top periphery, (j) attaching said waist pocket flaps to a waist panel top periphery, said chamber pocket flaps are attached to said pocket chamber panels, said shoulder pocket flaps, are attached to said shoulder pocket panels, and said waist pocket flaps are attached to said waist pocket panels;

(k) aligning and attaching said chamber pocket panels to a chamber panel anterior side and a chamber panel posterior side, said chamber pocket panels are secured horizontally across and vertically down said chamber panels creating bendable rows and columns of pocket panels, (l) aligning and attaching said shoulder pocket panels to a shoulder panel anterior side and a shoulder panel posterior side, securing said shoulder pocket panels horizontally across and vertically down said shoulder panels, creating a right shoulder strap with pockets and a left shoulder strap with pockets, (m) aligning and attaching said waist pocket panels to a waist panel anterior side and a waist panel posterior side, securing said waist pocket panels horizontally across and vertically down said waist panels, creating a right waist strap and a left waist strap with pockets;

(n) attaching and securing a right shoulder extension strap and a left shoulder extension strap to said right and left shoulder straps, extending said shoulder straps over the wearer's shoulders and securing the pocket assemblage to the wearer's body, allowing for sizing, adjusting, and reconfigurations;

(o) attaching said waist extension straps to said right and left waist straps and securing said waist straps around the wearer's waist for securing the pocket assemblage to the wearer's body allowing for sizing, adjusting, and reconfigurations;

(p) permanently securing a plurality of releasable chamber mating attachments on said chamber panels, said chamber mating attachments allow for chamber panels to be detachable and reconfigurable;

(q) permanently securing a plurality of releasable shoulder mating attachments to said right and left shoulder straps for attaching said shoulder straps to said chamber panels;

(r) permanently securing a plurality of releasable waist mating attachments to said right and left waist straps for attaching the waist straps to said chamber panels;

(s) permanently securing said mating attachments to said right and left shoulder extension straps;

(t) permanently securing said mating attachments to said anterior and said posterior sides of said right and left waist-extension straps, (u) aligning and connecting said chamber mating attachments located on a periphery of said chamber panels forming detachable chambers with pockets;

(v) forming an upper body modular assemblage by attaching said shoulder panel, said shoulder pocket panels, said shoulder pocket flap, said right and left should extension strap and said shoulder mating attachments together;

(w) forming a lower body modular assemblage by attaching said waist panels, said waist pocket panels, said waist pocket flaps, said right and left waist extension straps and said waist mating attachments together;

(x) attaching mating attachments on a top periphery of said upper body modular assemblage and mating attachments on a left periphery of said lower body modular assemblage with the chamber mating attachments of the chamber panels forming a detachable, multi-functional, reconfigurable modular assemblage of pockets; and (y) disconnecting and reconfiguring the modular assemblage to create different assemblages for different uses.

2. The method of claim 1 wherein said mating attachments includes a plurality hooks and a plurality of loops.

3. The method of claim 1 wherein said flexible material includes vinyl, cloth, mesh, and webbing.

4. The method of claim 1 wherein said securing process includes heat sealing and sewing.

5. The method of claim 1, further including a plurality of additional extensions straps to accommodate users of different sizes.

* * * * *